US011128088B2

(12) United States Patent
Shinyama et al.

(10) Patent No.: US 11,128,088 B2
(45) Date of Patent: Sep. 21, 2021

(54) WATERPROOF AND AIRTIGHT CONNECTOR

(71) Applicant: Molex, LLC, Lisle, IL (US)

(72) Inventors: Makoto Shinyama, Yamato (JP); Takaaki Hirayama, Yamato (JP); Yuya Sato, Yamato (JP)

(73) Assignee: Molex, LLC, Lisle, IL (US)

( * ) Notice: Subject to any disclaimer, the term of this patent is extended or adjusted under 35 U.S.C. 154(b) by 0 days.

(21) Appl. No.: 16/756,122

(22) PCT Filed: Oct. 29, 2018

(86) PCT No.: PCT/US2018/057964
§ 371 (c)(1),
(2) Date: Apr. 15, 2020

(87) PCT Pub. No.: WO2019/089438
PCT Pub. Date: May 9, 2019

(65) Prior Publication Data

US 2020/0244004 A1 Jul. 30, 2020

(51) Int. Cl.
*H01R 13/52* (2006.01)
*H01R 13/24* (2006.01)
*H01R 103/00* (2006.01)

(52) U.S. Cl.
CPC ..... *H01R 13/5219* (2013.01); *H01R 13/2492* (2013.01); *H01R 13/521* (2013.01); *H01R 2103/00* (2013.01)

(58) Field of Classification Search
CPC ..... H01R 13/2492; H01R 13/521; H01R 13/5219; H01R 2103/00
(Continued)

(56) References Cited

U.S. PATENT DOCUMENTS 3,588,039 A * 6/1971 Chelminski ..... F16K 31/0693 251/129.15
4,245,194 A * 1/1981 Fahlen et al. ..... H01S 3/0971 372/103
(Continued)

FOREIGN PATENT DOCUMENTS

CN 103875133 A 6/2014
CN 205452682 U 8/2016
(Continued)

OTHER PUBLICATIONS

International Search report and written opinion received for PCT application No. PCT/US2018/057964, dated Feb. 22, 2019, 9 pages.

*Primary Examiner* — Abdullah A Riyami
*Assistant Examiner* — Vladimir Imas

(57) ABSTRACT

A terminal can be slidably held while liquid-tightness and airtightness are steadily maintained. Included are a base part where a rear through-hole is formed; a terminal storage case which includes a front plate part where a front through-hole is formed, and in which a rear end is connected to the base part; a terminal that includes an axis part, a contact part, and a flange, the rear end proximity part of the axis part being slidably inserted into the rear though-hole, and the contact part being slidably inserted into the front through-hole; an energizing member that is mounted on the circumference of the axis part and energizes the flange to a front; and a cylindrical sealing member that includes a first sealing member interposed between the tip end of the energizing member and the flange, a second sealing member interposed between the rear end of the energizing member and the base part, and a central cylinder for connecting the first sealing member with the second sealing member.

14 Claims, 27 Drawing Sheets

(58) Field of Classification Search
USPC ..... 439/271
See application file for complete search history.

(56) References Cited

U.S. PATENT DOCUMENTS

| | | | | |
|---|---|---|---|---|
| 6,431,912 | B1 | 8/2002 | Mori | |
| 8,851,937 | B2 * | 10/2014 | Kawai | H01R 13/6315 439/754 |
| 2005/0048848 | A1 | 3/2005 | Axenbock et al. | |
| 2013/0149918 | A1 | 6/2013 | Kawai et al. | |
| 2014/0220801 | A1 | 8/2014 | Shimizu | |
| 2015/0125325 | A1 * | 5/2015 | Flett | F04D 13/086 417/423.3 |
| 2015/0325943 | A1 | 11/2015 | Frey et al. | |

FOREIGN PATENT DOCUMENTS

| | | | |
|---|---|---|---|
| CN | 107230858 | A | 10/2017 |
| EP | 3193405 | A1 | 7/2017 |
| JP | 2001-143810 | A | 5/2001 |
| TW | 201733210 | A | 9/2017 |
| WO | 2019/089438 | A1 | 5/2019 |

* cited by examiner

FIG. 1A
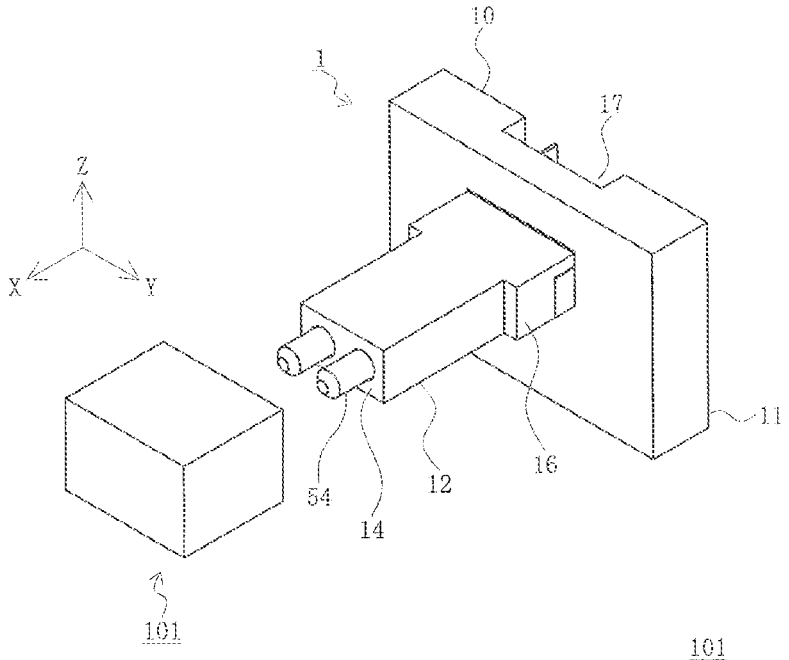
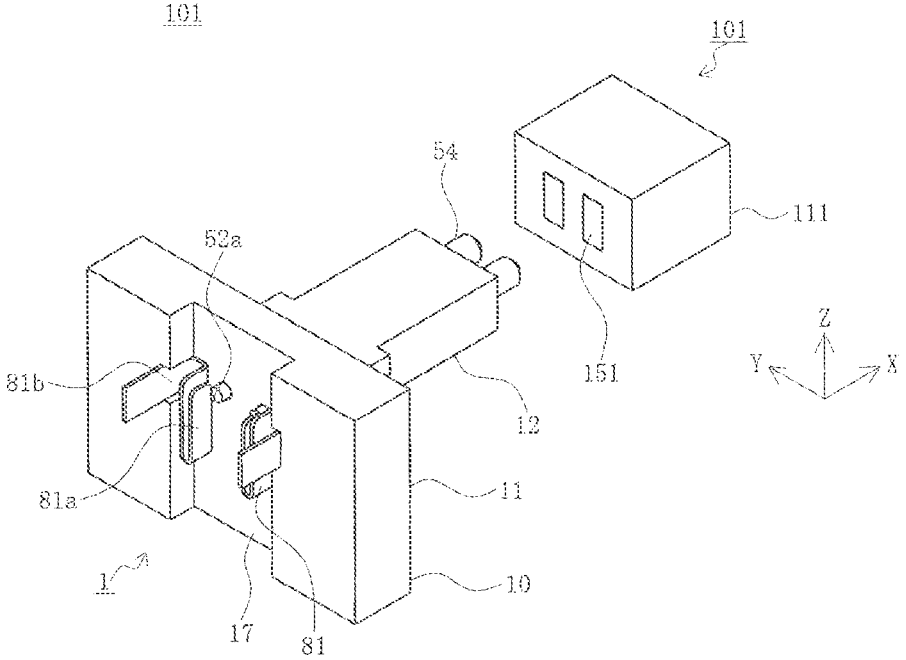
FIG. 1B

WATERPROOF AND AIRTIGHT CONNECTOR

RELATED APPLICATIONS

This application claims priority to International Application No. PCT/US2018/057964, filed Oct. 29, 2018, which claims priority to Japanese Application No. 2017-209952, filed Oct. 31, 2017, and Japanese Application No. 2018-071792, filed Apr. 3, 2018, each of which are incorporated herein by reference in their entirety.

TECHNICAL FIELD

The present disclosure relates to a connector.

BACKGROUND ART

Conventionally, there have been proposed connectors including a movable terminal that is energized by a coil spring, as a terminal assembly used for a connector for electrically connecting a power source such as a battery and the like with electronic equipment, electrical equipment, and the like (for example, see Patent Document 1).

FIG. 27 is a cross-sectional view of a conventional connector.

In the figure, 811 denotes a wall part of a housing included in a connector, and 812 denotes a terminal storage part of the housing mounted on the wall part 811. Further, 851 denotes a terminal, which is slidably stored in the terminal storage part 812 in a front-and-rear direction right-and-left direction in the figure). Moreover, a power line 881 is connected to the rear end of the terminal 851. The power line 881 is a feeder connected to a power source such as a battery (not illustrated), and the tip end thereof is inserted into the terminal storage part 812 through a through-hole formed in the wall part 811 and connected to the rear end of the terminal 851.

Additionally, the terminal 851 includes a flange 853 and a contact protrusion 854 extended from the flange 853 to the front (left in the figure). The front end face 854*a* of the contact protrusion 854 is a part that comes in contact with a mating terminal 951 loaded on a mating housing 911 of a mating connector connected to electronic equipment, electrical equipment, or the like (not illustrated). In addition, the flange 853 is a part that receives the energizing force of a coil spring 871 loaded in the terminal storage part 812, thereby being energized to the front, Additionally, when the connector is connected to the mating connector, the terminal storage part 812 and the mating housing 911 come close to and come in contact with each other, the front end face 854*a* of the contact protrusion 854 comes in contact with the mating terminal 951, and the terminal 851 is pressed to the rear (right in the figure). Moreover, the coil spring 871 elastically contracts, and the terminal 851 slides to the rear while the front end face 854*a* maintains a state of contact with the mating terminal 951.

Further, a sealing member is disposed in the connector to maintain water-proof and dust-proof properties. Specifically, a front sealing member 833 is disposed on the circumference of the contact protrusion 854 in front with respect to the flange 853, and a rear sealing member 834 is disposed on the circumference of the power line 881 adjacently disposed to the wall part 811.

The outer circumference of the front sealing member 833 is fixed on the inner circumferential face of the terminal storage part 812, and the inner circumference of the front sealing member 833 comes in contact with the outer circumferential face of the contact protrusion 854, which functions as a sealing lip. In addition, the rear sealing member 834 is a cylindrical member having a bellows shape. Moreover, the outer diameter of the front end part 834*a* of the rear sealing member 834 is smaller than the inner diameter of the terminal storage part 812, and the inner circumference of the front end part 834*a* comes in contact with the outer circumferential face of the power line 881, which functions as a sealing lip, and the inner diameter of the rear end part 834*b* of the rear sealing member 834 is larger than the outer diameter of the power line 881, and the outer circumference of the rear end part 834*b* comes in contact with the inner circumferential face of the terminal storage part 812, which functions as a sealing lip.

Thus, the front sealing member 833 is disposed on the circumference of the contact protrusion 854, and the rear sealing member 834 is disposed on the circumference of the power line 881. Therefore, even when the terminal 851 and the power line 881 connected to the terminal 851 slide in the terminal storage part 812, water-proof and dust-proof properties can be steadily maintained.

Patent Document 1: Japanese Patent Application Publication No. 2001-143810

SUMMARY

However, as for the conventional connector, the structure of the front sealing member 833 and the rear sealing member 834 is complicated, which leads to high cost. In addition, the mounting structure of the front sealing member 833 and the rear sealing member 834 is also complicated, and therefore, a mounting operation requires time, and the cost of manufacturing is increased. Further, the inner circumference of the front sealing member 833 is in sliding contact with the outer circumferential face of the contact protrusion 854, and the inner circumference of the front end part 834*a* of the rear sealing member 834 is in sliding contact with the outer circumferential face of the power line 881, which is prone to cause friction, and when used for a long period of time, there is a high possibility that the function as a sealing lip is reduced.

Herein, an object is to provide a connector of high reliability which solves the problems with the conventional connector, with simple structure, easy assembly, and low cost, which is capable of slidably holding a terminal while steadily maintaining liquid-tightness and airtightness, and which is capable of steadily maintaining a conduction state with respect to a mating terminal of a mating connector.

Thus, a connector includes: a housing configured to include a base part where a rear through-hole is formed, and a terminal storage case which includes a front plate part where a front through-hole is formed, and in which a rear end is connected to the base part; a terminal configured to include an axis part, a contact part connected to a tip end of the axis part, and a flange disposed at a boundary part between the contact part and the axis part, a rear end proximity part of the axis part being slidably inserted into the rear though-hole, a conduction body being connected to a part of the rear end proximity part, the part protruding rearward with respect to a rear face of the base part, the contact part being slidably inserted into the front through-hole, and a front end of the contact part protruding forward with respect to the front plate part being contactable with a mating terminal of a mating connector; an energizing member configured to be mounted on a periphery of the axis part and energize the flange to a front; and a cylindrical sealing member configured to include a first sealing member interposed between a tip end of the energizing member and the flange, a second sealing member interposed between a rear end of the energizing member and the base part, and a central cylinder for connecting the first sealing member with the second sealing member.

As for another connector, furthermore, a rear end face of the second sealing member is pressed against a front face of the base part, thereby providing sealing contact between the rear end face and the front face.

As for yet another connector, furthermore, a front end face of the first sealing member is pressed against a rear face of the flange, thereby providing sealing contact between the front end face and the rear face.

As for yet another connector, furthermore, the energizing member is embedded in a cylindrical sealing member, a front part of the cylindrical sealing member with respect to a front end of the energizing member is the first sealing member, and a rear part of the cylindrical sealing member with respect to a rear end of the energizing member is the second sealing member.

As for yet another connector, furthermore, the cylindrical sealing member includes a center hole extended in a front-and-rear direction, and the terminal and the cylindrical sealing member are combined in such a manner that the axis part is stored in the center hole, and are stored in a terminal storage cavity of the terminal storage case.

As for yet another connector, furthermore, a part including at least the first sealing member and a part including at least the second sealing member in the cylindrical sealing member include an inside part positioned inside the energizing member and an outside part positioned outside the energizing member.

As for yet another connector, furthermore, the inside part and the outside part are cylindrical.

As for yet another connector, furthermore, the inside part is cylindrical, and a cross-sectional face of an outer circumferential face of the outside part is approximately a regular square.

As for yet another connector, furthermore, an area of a cross-sectional face of the inside part and an area of the cross-sectional face of the outside part are identical.

As for yet another connector, furthermore, a preload is applied to the energizing member, in a state where the front end of the contact part is not in contact with the mating terminal of the mating connector, the front end face of the first sealing member is pressed against the rear face of the flange, and the front end face of the second sealing member is pressed against the front face of the base part.

As for yet another connector, furthermore, a radial-direction energizing member is disposed in a circumference of the first sealing member, and at least a part of an inner circumferential face of the first sealing member is pressed against an outer circumferential face of the axis part, thereby providing sealing contact between the inner circumferential face and the outer circumferential face.

As for yet another connector, furthermore, the connector includes the cylindrical sealing member that includes the first sealing member, the second sealing member, and the central cylinder having both ends integrally connected to the first sealing member and the second sealing member, an outer diameter of the second sealing member is larger than an outer diameter of the central cylinder, an engaging protrusion engaged with the radial-direction energizing member is formed on the outer circumference of the first sealing member, the energizing member is disposed on an outside of the central cylinder, and a front end and a rear end of the energizing member abut the radial-direction energizing member and the second sealing member.

As for yet another connector, furthermore, the cylindrical sealing member includes a center hole extended in a front-and-rear direction, the axis part is stored in the center hole, a part of the inner circumferential face of the first sealing member is a sealing ring that protrudes to a center of the center hole, and the sealing ring is pressed against the outer circumferential face of the axis part.

As for yet another connector, furthermore, a preload is applied to the energizing member in a state where the front end of the contact part is not in contact with the mating terminal of the mating connector, and the rear end face of the second sealing member is pressed against the front face of the base part.

The present disclosure is capable of simplifying structure, facilitating assembly, achieving low cost, and slidably holding the terminal while steadily maintaining liquid-tightness and airtightness, and is capable of steadily maintaining a conduction state with respect to the mating terminal of the mating connector.

BRIEF DESCRIPTION OF THE DRAWINGS

FIGS. 1A and 1B are perspective views of a connector and a mating connector of a first embodiment, and herein, FIG. 1A is a view viewed from a diagonal front, and FIG. 1B is a view viewed from a diagonal rear.

FIG. 2A is a lower face view and FIG. 2B is a cross-sectional side view which is a cross-sectional view taken along a line A-A of FIG. 2A.

FIG. 7A is a view illustrating a state where a terminal storage case is removed from FIG. 6, FIG. 7B is a view illustrating a state where a terminal is removed from FIG. 7A, and FIG. 7C is a view illustrating a state where an elastic cylindrical member is removed from FIG. 7B.

FIG. 8A is a view viewed from a diagonal rear, and FIG. 8B is a cross-sectional side view.

FIG. 9A is a view viewed from a diagonal rear, and FIG. 9B is a cross-sectional side view.

FIG. 10A is a view viewed from a diagonal front, and FIG. 10B is a view viewed from a diagonal rear.

FIG. 11A is a lower face view, and FIG. 11B is a cross-sectional side view which is a cross-sectional view taken along a line B-B of FIG. 11A.

FIG. 13A is a partial cross-sectional view of the connector viewed from a diagonal rear, and FIG. 13B is a view illustrating a state where a base part is removed from FIG. 13A.

FIG. 14A is a view illustrating a state where a terminal storage case is removed from FIG. 13B, FIG. 14B is a view illustrating a state where a terminal is removed from FIG. 14A, and FIG. 14C is a view illustrating a state where an elastic cylindrical member is removed from FIG. 14B.

FIG. 16A is a partial cross-sectional view of the connector viewed from a diagonal rear, and FIG. 16B is a view illustrating a state where a base part is removed from FIG. 16A.

FIG. 17A is a view illustrating a state where a terminal storage case is removed from FIG. 16B, FIG. 17B is a view illustrating a state where a terminal is removed from FIG. 17A, and FIG. 17C is a view illustrating a state where an elastic cylindrical member is removed from FIG. 17B.

FIG. 19A is a partial cross-sectional view of a connector viewed from a diagonal rear, and FIG. 19B is a view illustrating a state where a base part is removed from FIG. 19A.

FIG. 20A is a view illustrating a state where a terminal storage case is removed from FIG. 16B, FIG. 20B is a view illustrating a state where a terminal is removed from FIG. 20A, and FIG. 20C is a view illustrating a state where an elastic cylindrical member is removed from FIG. 20B.

FIG. 21A is a lower face view, and FIG. 21B is a cross-sectional side view which is a cross-sectional view taken along a line C-C of FIG. 21A.

FIG. 24A is a partial cross-sectional view of a connector viewed from a diagonal rear, and FIG. 24B is a view illustrating a state where a base part is removed from FIG. 24A.

FIG. 25A is a view illustrating a state where a terminal storage case is removed from FIG. 24B, and FIG. 25B is a view illustrating a state where an energizing ring is removed from FIG. 25A.

FIG. 26A is a view illustrating a state where a terminal is removed from FIG. 25B, and FIG. 26B is a view illustrating a state where an elastic cylindrical member is removed from FIG. 26A.

DETAILED DESCRIPTION OF THE PREFERRED EMBODIMENTS

Hereinafter, embodiments will be described in detail with reference to drawings.

Figure 2A:
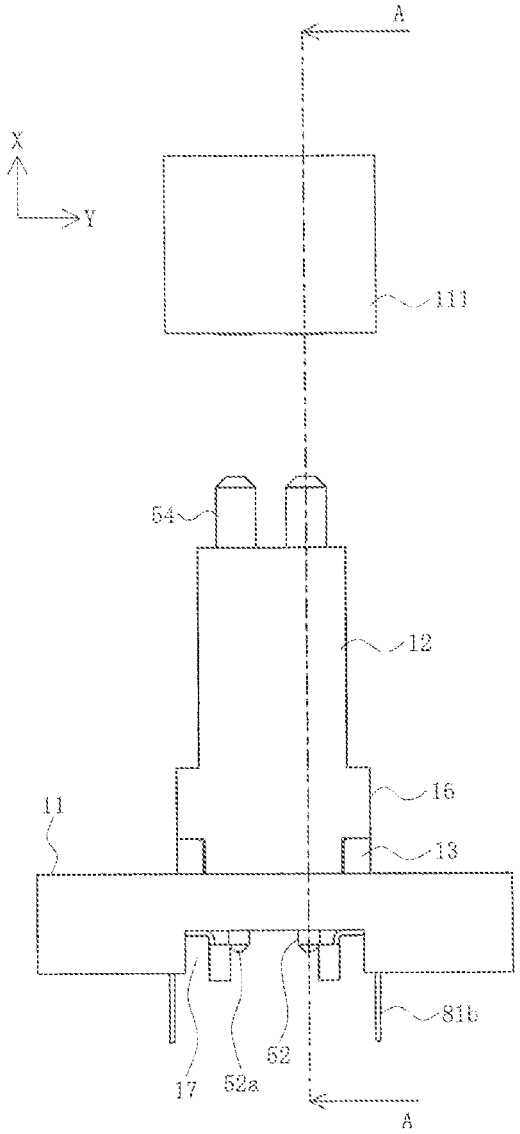
FIGS. 2A and 2B are two-way views of the connector and the mating connector of the first embodiment, and herein.
Figure 2B:
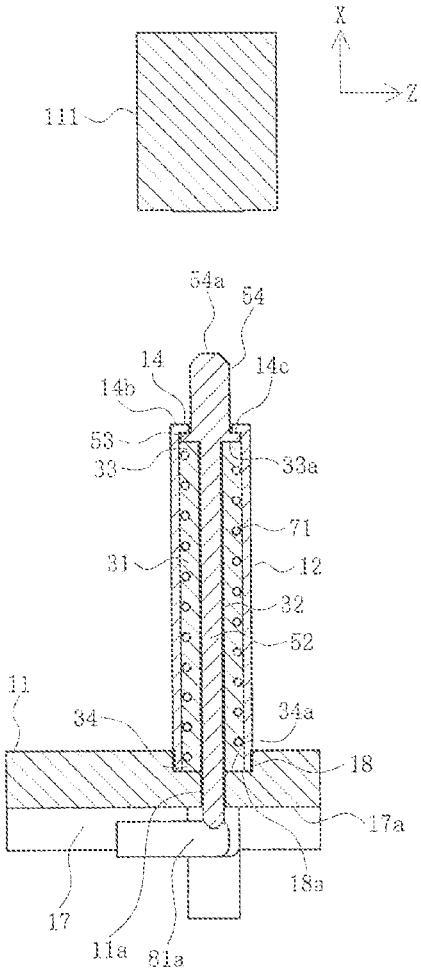
Figure 3:
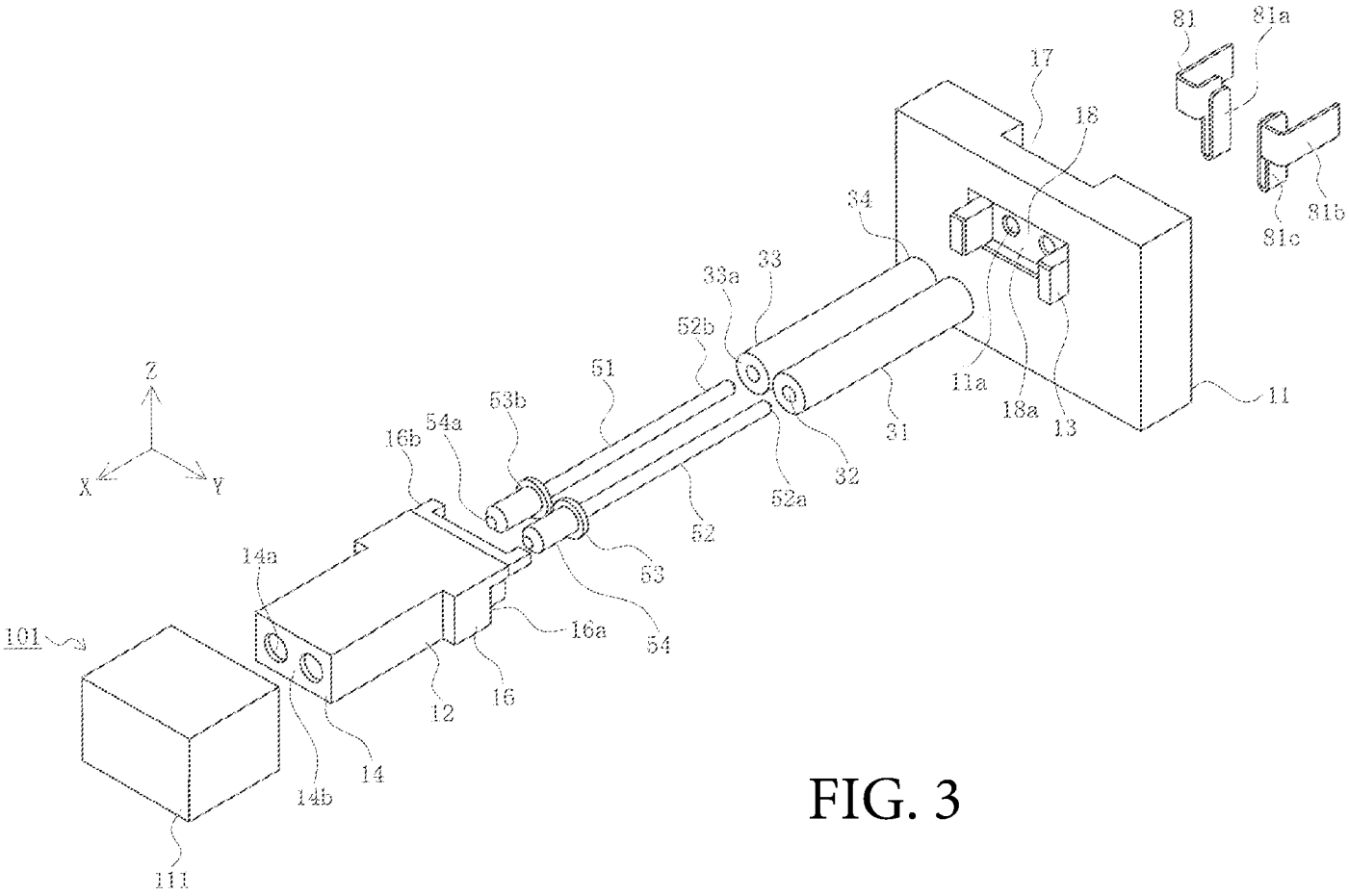
FIG. 3 is a first exploded view of the connector and the mating connector of the first embodiment.
Figure 4:
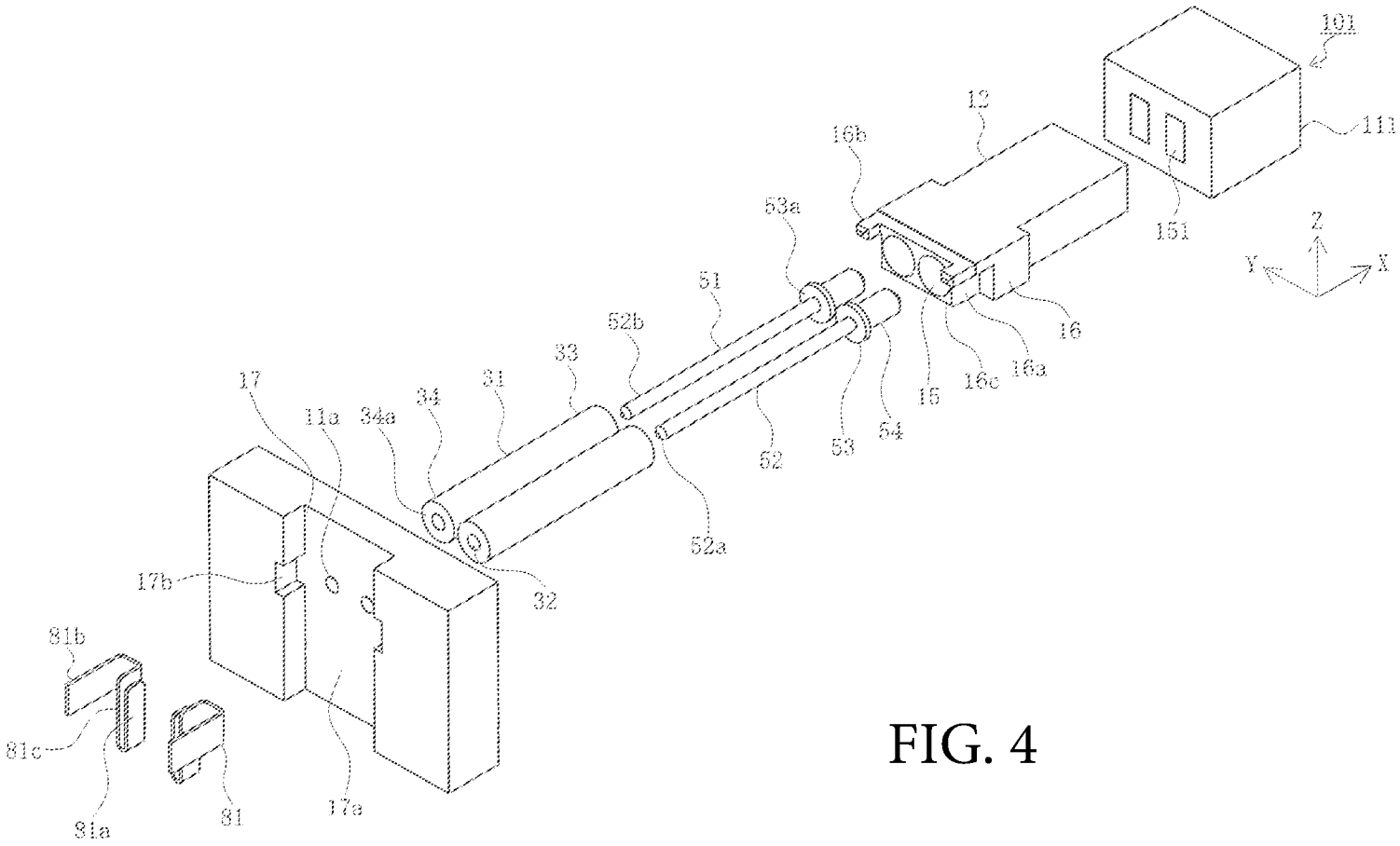
FIG. 4 is a second exploded view of the connector and the mating connector of the first embodiment.
Figure 5:
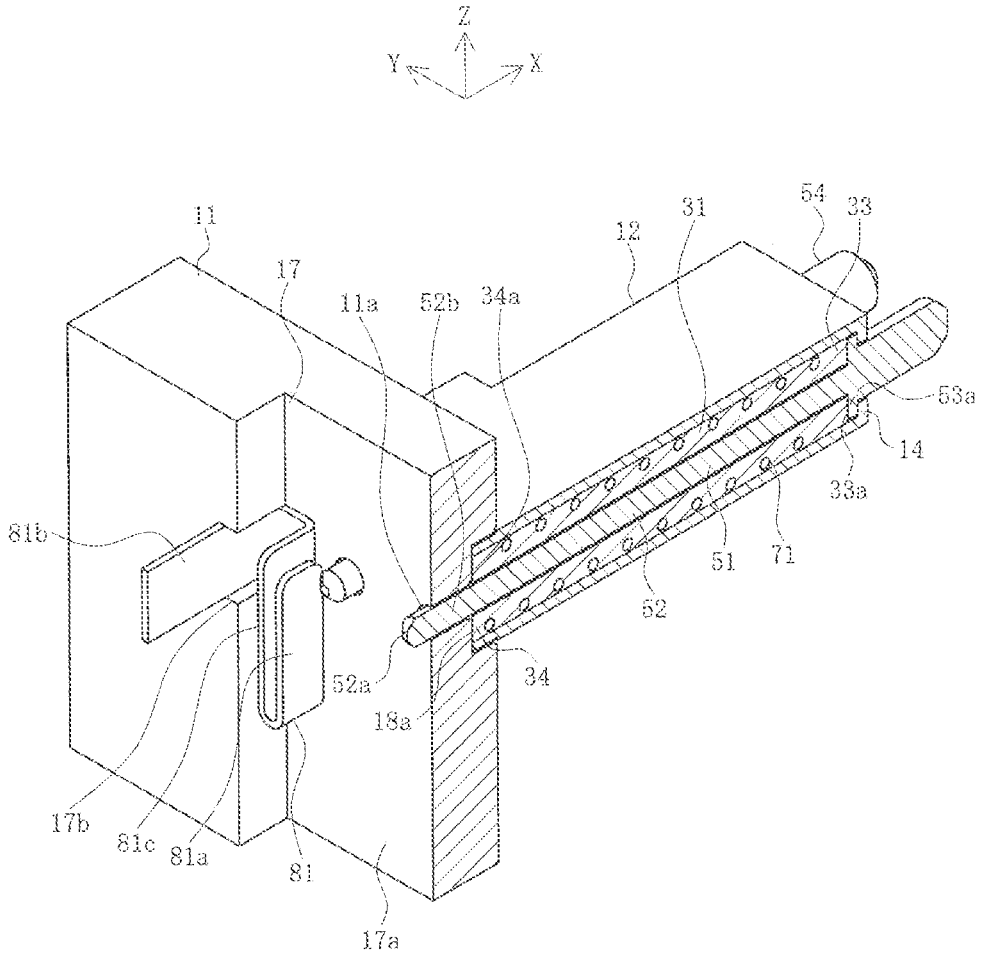
FIG. 5 is a partial cross-sectional view of the connector of the first embodiment.
Figure 6:
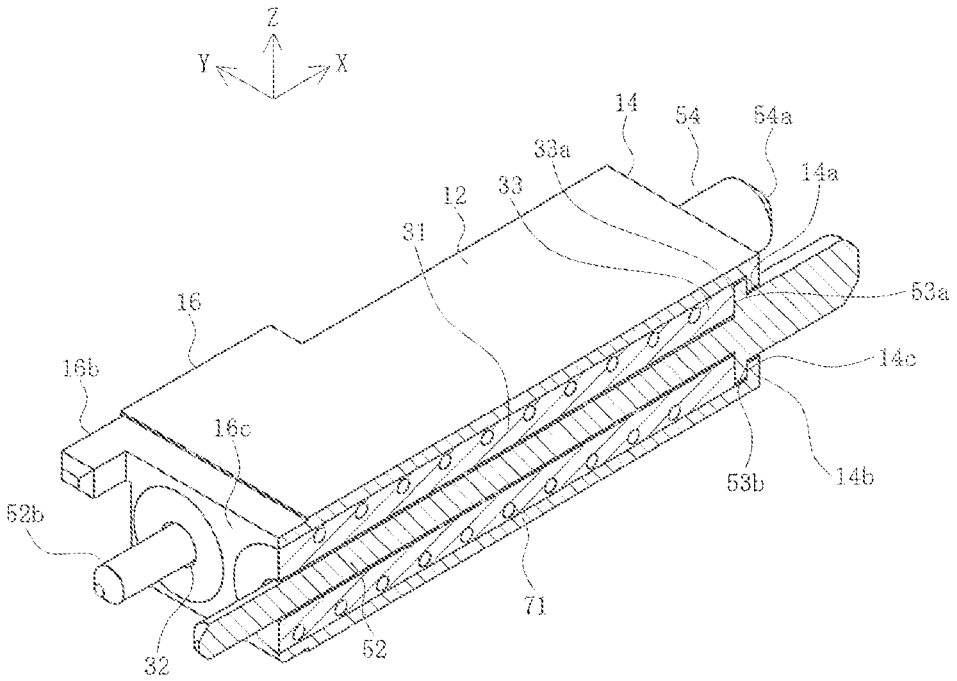
FIG. 6 is a view illustrating a state where a base part of a housing is removed from FIG. 5.
Figure 7A:
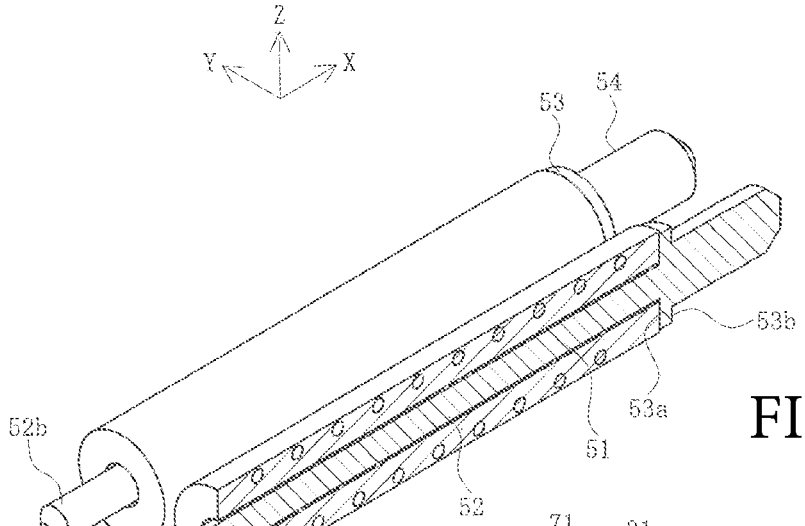
FIGS. 7A through 7C are views illustrating a state where members are further removed from FIG. 6, and herein.
Figure 7B:
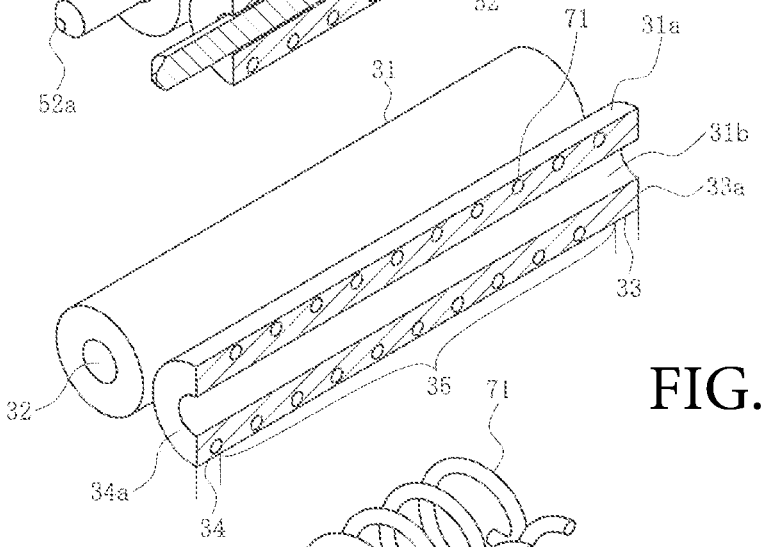
Figure 7C:
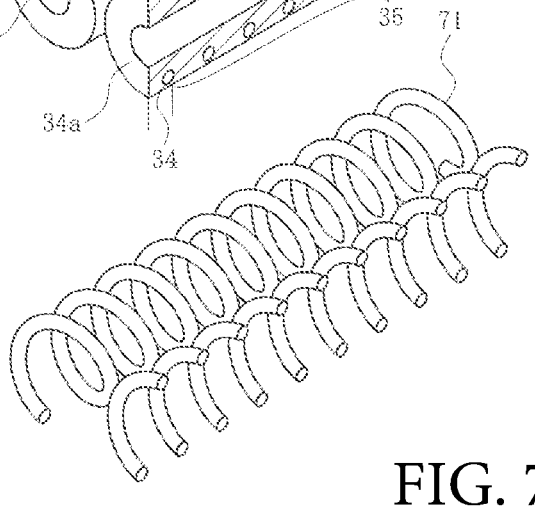
Figure 8A:
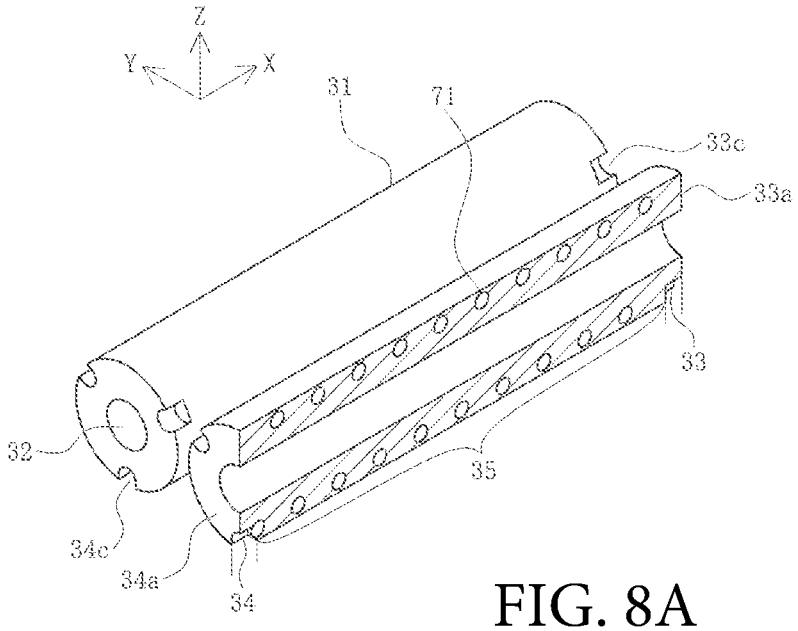
FIGS. 8A and 8B are partial cross-sectional views of the elastic cylindrical member in which a coil spring of the first embodiment is embedded, and herein.
Figure 8B:
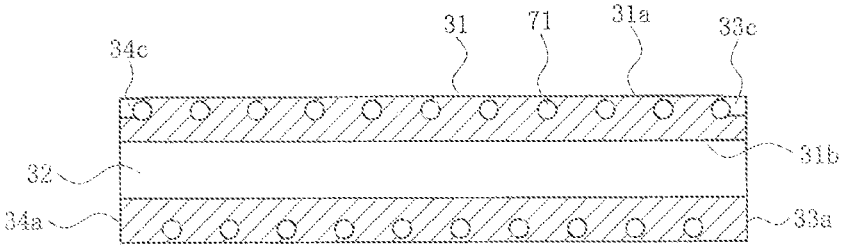
Figure 9A:
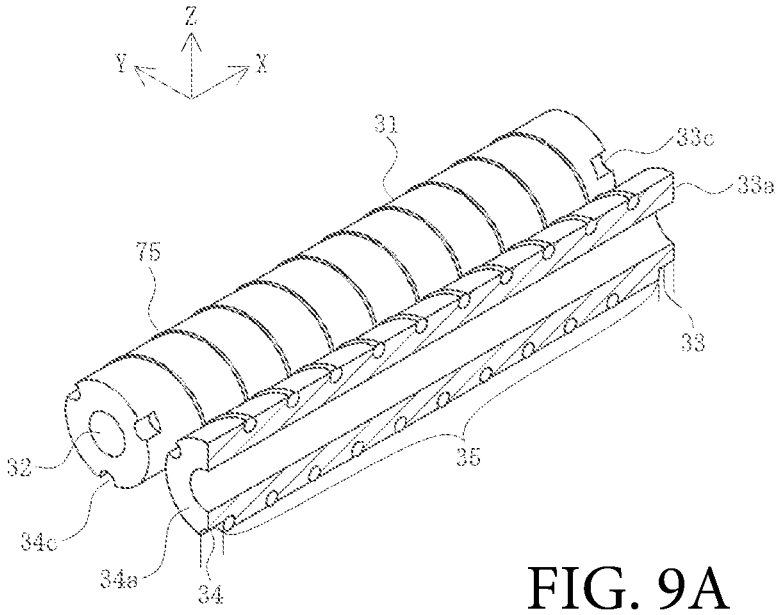
FIGS. 9A and 9B are partial cross-sectional views of a modified example of the elastic cylindrical member in which the coil spring of the first embodiment is embedded, and herein.
Figure 9B:
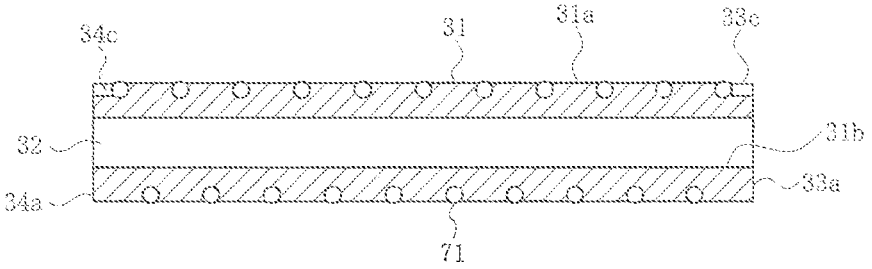

FIGS. 1A and 1B are perspective views of a connector and a mating connector of a first embodiment; FIGS. 2A and 2B are two-way views of the connector and the mating connector of the first embodiment; FIG. 3 is a first exploded view of the connector and the mating connector of the first embodiment; FIG. 4 is a second exploded view of the connector and the mating connector of the first embodiment; FIG. 5 is a partial cross-sectional view of the connector of the first embodiment; FIG. 6 is a view illustrating a state where a base part of a housing is removed from FIG. 5; FIGS. 7A through 7C are views illustrating a state where members are further removed from FIG. 6; FIGS. 8A and 8B are partial cross-sectional views of the elastic cylindrical member in which a coil spring of the first embodiment is embedded; and FIGS. 9A and 9B are partial cross-sectional views of a modified example of the elastic cylindrical member in which the coil spring of the first embodiment is embedded. Note that in FIGS. 1A and 1B, FIG. 1A is a view viewed from a diagonal front, and FIG. 1B is a view viewed from a diagonal rear; in FIGS. 2A and 2B, FIG. 2A is a lower face view, and FIG. 2B is a cross-sectional side view which is a cross-sectional view taken along a line A-A of FIG. 2A; in FIGS. 7A through 7C, FIG. 7A is a view illustrating a state where a terminal storage case is removed from FIG. 6, FIG. 7B is a view illustrating a state where a terminal is removed from FIG. 7A, and FIG. 7C is a view illustrating a state where an elastic cylindrical member is removed from FIG. 7B; and in FIGS. 8A and 8B and FIGS. 9A and 9B, FIGS. 8A and 9A are views viewed from a diagonal rear, and FIGS. 8B and 9B are cross-sectional side views.

In the drawings, 1 denotes the connector of the first embodiment and includes a housing 10 including a base part 11 and a terminal storage case 12 connected to the base part 11, and terminals 51 loaded on the housing 10. In addition, 101 denotes a mating connector that includes mating terminals 151 being contactable with the terminals 51 and a mating housing 111 to which the mating terminals 151 are mounted. The connector 1 can be used to connect a power line for connecting a power source such as a battery with members that consume electric power in electronic equipment, electrical equipment, or the like. Similarly, the connector 1 can be also used to connect a signal line.

Note that the electronic equipment, electrical equipment, or the like to which the connector 1 is mounted may be any kind of equipment, and herein, is equipment having a relatively small size to the extent that can be easily carried by a person. Additionally, in the explanation, it is assumed that the dimension of the connector 1 in the front-and-rear direction (X-axis direction) is approximately 1.5 [cm].

Note that expressions for indicating directions such as up, down, left, right, front, and back, used to describe the operations and configurations of the parts of the connector 1 and the mating connector 101 in the present embodiment are not absolute but rather relative directions. These expressions are appropriate in the case where the parts of the connector 1 and the mating connector 101 are in the positions illustrated in the figures, however, when the positions of the parts of the connector 1 and the mating connector 101 change, the expressions should be interpreted differently in accordance with the change in position.

The base part 11 of the housing 10 is a member formed of a material having insulation properties such as resin or the like, and is a plate-like member extended in a Y-Z direction in the example illustrated in the figure. Note that the base part 11 may be part of the wall of a casing that covers the periphery of the equipment, and in this case, the front (positive X-axis direction) of the base part 11 corresponds to the outside of the casing, and the rear (negative X-axis direction) of the base part 11 corresponds to the inside of the casing. Moreover, a front recess part 18 to which a connection part 16 formed at the rear end of the terminal storage case 12 is connected is formed on the front face of the base part 11. Bottom face 18*a* of the front recess part 18 is part of the front face of the base part 11 and is a plane formed backward in a recessed manner with respect to a peripheral face, wherein rear through-holes 11*a* are formed as a through-hole into which a rear end proximity part 52*b* of an axis part 52 of the terminal 51 is slidably inserted. Connection protrusions 13 that protrude to the front are disposed on both right and left ends of the front recess part 18. In addition, a rear recess part 17 is formed on a section corresponding to the front recess part 18 on the rear face of the base part 11. Bottom face 17*a* of the rear recess part 17 is part of the rear face of the base part 11 and is a plane formed forward in a recessed manner with respect to a peripheral face, wherein rear ends of the rear through-holes 11*a* that penetrate the base part 11 in the thickness direction (X-axis direction) are opened. Moreover, metal fitting recess parts 17*b* to which conduction metal fittings 81 as a conduction body are mounted are formed on both right and left side walls of the rear recess part 17.

The terminal storage case 12 is a member formed of a material having insulation properties such as resin or the like and is a plate-like member extended in a X-Y direction in the example illustrated in the figure, and a connection part 16 having a wide width is formed at the rear end thereof (end in the negative X-axis direction). The connection part 16 includes connection recess parts 16*a* formed on both right and left sides and connection protrusions 16*b* that protrude from a rear end face 16*c* to the rear. Moreover, when the connection part 16 is connected to the front recess part 18 of the base part 11, the connection protrusions 13 enter and engage the connection recess parts 16*a*, and the connection protrusions 16*b* enter and engage connection recess parts (not illustrated) formed in the front recess part 18, and the rear end face 16*c* abuts the bottom face 18*a* of the front recess part 18. Note that mounting metal fittings (so-called nails) can be used in place of the connection protrusions 16*b*.

In addition, the terminal storage case 12 includes terminal storage cavities 15 extended in the front-and-rear direction (X-axis direction) and a front plate part 14 positioned at a front end (end in the positive X-axis direction). When the connector 1 is connected to the mating connector 101, the front end face 14*b* of the front plate part 14 functions as a fitting face of the connector 1 that abuts or comes close to the fitting face of the mating connector 101. The terminal storage cavities 15 are cylindrical elongate cavities, and the rear ends thereof are opened on the rear end face 16*c* of the connection part 16, but the front ends thereof are blocked by the front plate part 14. However, front through-holes 14*a* having diameters smaller than those of the terminal storage cavities 15 are formed in sections corresponding to the terminal storage cavities 15 in the front plate part 14, and the terminal storage cavities 15 communicate with a space in front of the front end face 14*b* through the front through-holes 14*a*. The inner diameters of the terminal storage cavities 15, for example, are approximately 1.8 [mm] but can be changed as appropriate. In the examples illustrated in the figures, the two terminal storage cavities 15 are arranged side by side in the width direction (Y-axis direction), however, the number of terminal storage cavities 15 can be appropriately changed in accordance with the number of terminals 51 included in the connector 1 and can be freely selected, and moreover, the form of arrangement of the terminal storage cavities 15 can be appropriately changed in accordance with the form of arrangement of the mating terminals 151.

In each terminal storage cavity 15, one terminal 51 and an elastic cylindrical member 31 as one cylindrical sealing member that includes a coil spring 71 as an energizing member are stored. In the examples illustrated in the figures, the terminal 51 formed of materials having conductivity such as metal or the like includes an elongate, cylindrical axis part 52 extended in the front-and-rear direction, a cylindrical contact part 54 that is connected to the tip end of the axis part 52 and extended in the front-and-rear direction, and a collar flange 53 disposed at the boundary part between the contact part 54 and the axis part 52. Moreover, the front end 54*a* of the contact part 54 is a part that comes in contact with the mating terminal 151 and electrically conducts, and the outer diameter of the contact part 54 is set larger than the outer diameter of the axis part 52, and the outer diameter of the flange 53 is set larger than the outer diameter of the contact part 54. The outer diameter of the axis part 52, for example, is approximately 0.6 [mm] but can be changed as appropriate. Note that the terminal 51 may be integrally formed, but the axis part 52, the flange 53, and the contact part 54 may be separately molded and mutually joined by a means such as screwing, welding, gluing, or the like.

In the present embodiment, the elastic cylindrical member 31 formed of an elastomer and the metallic coil spring 71 are integrally formed by overmolding (insert molding), and the coil spring 71 is embedded in the elastic cylindrical member 31, as illustrated in FIG. 7B. The elastic cylindrical member 31 is a cylindrical member extended in the front-and-rear direction and includes a center hole 32 having a circular cross section and extended in the front-and-rear direction. Both ends of the center hole 32 are opened on a front end face 33*a* and a rear end face 34*a*, and the center hole 32 is a through-hole whose inner diameter extending across the entire length of the elastic cylindrical member 31 is constant, wherein the axis part 52 is stored. In addition, the outer diameter of the outer circumferential face 31*a* of the elastic cylindrical member 31 is constant across the entire length. As for the dimensions of the elastic cylindrical member 31, for example, a length in the front-and-rear direction is approximately 9.0 [mm], an outer diameter is approximately 1.7 [mm], and an inner diameter of the center hole 32 is approximately 0.8 [mm], however, the dimensions can be appropriately changed. Note that the length of the elastic cylindrical member 31 in the front-and-rear direction is set shorter than the length of the axis part 52 in the front-and-rear direction. The elastomer as the material of the elastic cylindrical member 31 is not limited to a thermoplastic elastomer (TPE) such as styrene, olefin or the like, but may be a thermosetting elastomer such as rubber or the like.

In addition, the coil spring 71, as illustrated in FIG. 7B, is not exposed to the outside of the elastic cylindrical member 31, that is, not exposed to any of the outer circumferential face 31*a*, the front end face 33*a*, the rear end face 34*a*, and the center hole 32 of the elastic cylindrical member 31. Note that in the examples illustrated in the figures, the outer diameter of the coil spring 71 is formed slightly smaller than the outer diameter of the elastic cylindrical member 31, and the coil spring 71 comes close to the outer circumferential face 31*a* of the elastic cylindrical member 31, however, the inner diameter of the coil spring 71 may be formed slightly larger than the inner diameter of the elastic cylindrical member 31, such that the coil spring 71 comes close to the inner circumferential face 31*b* of the elastic cylindrical member 31. Consequently, the elastic cylindrical member 31 integrally continues, and the elastomer continues from a first sealing member 33, a central cylinder 35, and further to a second sealing member 34, which are described later, such that the elastic cylindrical member 31 functions as a cylindrical sealing member.

Thus, the elastic cylindrical member 31 formed of the elastomer is integrated with the metallic coil spring 71, which provides robustness as a metallic core were included, and makes the shape of the member stable. Further, the entire spring property of the elastic cylindrical member 31 is improved, thereby preventing the elastic cylindrical member 31 from buckling, which causes bending.

As illustrated in FIG. 7A, the terminal 51 and the elastic cylindrical member 31 are assembled in such a manner that the axis part 52 is stored in the center hole 32, the flange 53 and the contact part 54 are positioned in front of the front end face 33*a*, the rear end 52*a* and the rear end proximity part 52*b* of the axis part 52 protrude to the rear of the rear end face 34*a*, and as illustrated in FIG. 6, the terminal 51 and the elastic cylindrical member 31 are stored in the terminal storage cavities 15 from the rear of the terminal storage case 12. Moreover, the contact part 54 is slidably inserted into the front through-hole 14*a*, and the front end 54*a* of the contact part 54 protrudes from the front end face 14*b* of the front plate part 14 to the front, however, because the outer diameter of the flange 53 is smaller than the inner diameter of the terminal storage cavity 15 and larger than the inner diameter of the front through-hole 14*a*, the front face 53*b* thereof abuts the rear face 14*c* of the front plate part 14, which causes the flange 53 to stop. In addition, the length of the elastic cylindrical member 31 in the front-and-rear direction is set slightly longer than the length of the terminal storage case 12 in the front-and-rear direction. Moreover, the rear end 52*a* and the rear end proximity part 52*b* of the axis part 52 protrude to the rear of the rear end face 16*c* of the connection part 16. Note that, as illustrated, the outer diameter of the axis part 52 is set smaller than the inner diameter of the center hole 32, and the outer diameter of the elastic cylindrical member 31 is set smaller than the inner diameter of the terminal storage cavity 15, and therefore, the axis part 52 can smoothly slide in the center hole 32, and the elastic cylindrical member 31 can smoothly slide in the terminal storage cavity 15.

Moreover, the rear end of the terminal storage case 12 in which the terminal 51 and the elastic cylindrical member 31 are stored in the terminal storage cavities 15, as illustrated in FIG. 5, is connected to the base part 11. Specifically, the connection part 16 formed at the rear end of the terminal storage case 12 is connected to the front recess part 18 of the base part 11, and the rear end face 16*c* of the connection part 16 abuts the bottom face 18*a* of the front recess part 18. In addition, the rear end proximity part 52*b* of the axis part 52 that protrudes to the rear of the rear end face 16*c* is slidably inserted into the rear through-hole 11*a* of the base part 11, and the rear end 52*a* of the axis part 52 protrudes from the bottom face 17*a* of the rear recess part 17 of the base part 11 to the rear. Moreover, parts of the rear end proximity part 52*b* that protrude from the bottom face 17*a* to the rear are connected to the conduction metal fittings 81 mounted on the metal fitting recess parts 17*b* formed on the side walls of the rear recess part 17 in an electrically conductive manner. Note that, as needed, a protrusion that protrudes to the outside in the radial direction may be formed in the vicinity of the rear end face 34*a* on the outer circumferential face 31*a* of the elastic cylindrical member 31, which makes it possible to set the outer diameter of the parts larger than the inner diameter of the terminal storage cavities 15. This create a state where the elastic cylindrical member 31 stored in the terminal storage cavity 15 is temporarily hooked by the protrusion, such that when the rear end of the terminal storage case 12 is connected to the base part 11, the terminal 51 and the elastic cylindrical member 31 can be prevented from coming off the terminal storage cavity 15.

In the examples illustrated in the figures, the conduction metal fitting 81 is a member formed integrally by applying bending to a conductive metal plate, and includes a main body piece 81*b* mounted on the metal fitting recess part 17*b*, a contact piece 81*a* in contact with the rear end proximity part 52*b* of the axis part 52, and a coupling piece 81*c* that couples the contact piece 81*a* with the main body piece 81*b*. A conductor (not illustrated) of the power line is connected to the main body piece 81*b*. In addition, the coupling piece 81*c* functions as a plate spring, presses the plate-like contact piece 81*a* to the side face of the rear end proximity part 52*b*, and causes the contact piece 81*a* and the rear end proximity part 52*b* to securely come in contact with each other. Note that the conduction metal fitting 81 is not necessarily limited to the example illustrated in the figures, and may be a member of any kind as long as the member can conduct electricity to the rear end proximity part 52*b* that protrudes from bottom face 17*a* to the rear.

As described above, the length in the front-and-rear direction of the elastic cylindrical member 31 that is integrated with the coil spring 71 is set slightly longer than the length in the front-and-rear direction of the terminal storage case 12, and when the rear end of the terminal storage case 12 is connected to the base part 11, the rear end face 34*a* is brought into a state of being displaced to the front by the bottom face 18*a* of the front recess part 18, and thus, the elastic cylindrical member 31 is compressed in the front-and-rear direction, and the coil spring 71 and the elastic cylindrical member 31 are in a state where a preload (preload) is applied.

Note that the entire length of the coil spring 71 is shorter than the entire length of the elastic cylindrical member 31, and the front end of the coil spring 71 is positioned backward with respect to the front end face 33*a*, and the rear end of the coil spring 71 is positioned forward with respect to the rear end face 34*a*. Moreover, the front part of the elastic cylindrical member 31 with respect to the front end of the coil spring 71 functions as a first sealing member 33 that elastically deforms by pressing with the front end of the coil spring 71, and the rear part of the elastic cylindrical member 31 with respect to the rear end of the coil spring 71 functions as a second sealing member 34 that elastically deforms by pressing with the rear end of the coil spring 71. In addition, a part between the first sealing member 33 and the second sealing member 34 serves as a central cylinder 35 for connecting the first sealing member 33 and the second sealing member 34. Thus, when the preload is applied to the coil spring 71, the front end face 33*a* is pressed to the rear face 53*a* of the flange 53 and functions as a first sealing face for providing sealing contact (adhesion) between the elastic cylindrical member 31 and the flange 53, and the rear end face 34*a* is pressed to the bottom face 18*a* of the front recess part 18 and functions as a second sealing face for providing sealing contact between the elastic cylindrical member 31 and the base part 11.

As described above, the elastic cylindrical member 31 formed of the elastomer is integrated with the coil spring 71 by overmolding (insert molding), and thus a plurality of protrusions that protrude to the center in the axial direction is formed at both ends in the axial direction in the cavity (cavity) of a die for molding in which the elastomer is filled, and the coil spring 71 can be positioned in the interior of the elastic cylindrical member 31 by causing any of the protrusions to abut both ends in the axial direction of the coil spring 71 inserted in the cavity and supporting the coil spring 71. Thus, when the elastic cylindrical member 31 in which the spring coil 71 is embedded is observed in detail, as illustrated in FIGS. 8A and 8B, front recess parts 33*c* and rear recess parts 34*c* each of which is formed of a protrusion are formed at a plurality of sections on the front end face 33*a* and the rear end face 34*a* of the elastic cylindrical member 31, and the front end and the rear end of the coil spring 71 are exposed from any of the front recess parts 33*c* and any of the rear recess parts 34*c*.

Further, as a modified example of the elastic cylindrical member 31, as illustrated in FIGS. 9A and 9B, part of the outer circumferential face of the coil spring 71 can be exposed on the outer circumferential face 31*a* of the elastic cylindrical member 31. Specifically, the outer diameter of the coil spring 71 and the inner diameter of the cavity of the die for molding are identically set, and the outer circumferential face of the coil spring 71 is abutted to the cylindrical inner circumferential face of the cavity to support the outer circumferential face of the coil spring 71, such that part of the outer circumferential face of the coil spring 71 can be exposed to the outer circumferential face 31*a* of the elastic cylindrical member 31.

Thus, the first sealing member 33 is interposed between the front end of the coil spring 71 and the flange 53 of the terminal 51, and the second sealing member 34 is interposed between the rear end of the coil spring 71 and the base part 11 of the housing 10, and the first sealing member 33 and the second sealing member 34 are connected, such that even when the terminal 51 is slidably mounted on the housing 10 in the front-and-rear direction, the front and the rear of the base part 11 can be blocked with liquid-tightness and airtightness, and dust, moisture, gas, and the like that exist in the space in front of the base part 11 can be securely prevented from entering the space in rear of the base part 11. Consequently, the electric conduction due to the contact between the conduction metal fitting 81 and the rear end proximity part 52*b* of the terminal 51 protruding to the rear of the base part 11 can be securely protected. More specifically, the front end face 33*a* of the first sealing member 33 functions as the first sealing face and is pressed against the rear face 53*a* of the flange 53, which securely provides sealing contact between the elastic cylindrical member 31 and the flange 53, such that even when dust, moisture, gas, and the like that exist in the space in front of the base part 11 enter the terminal storage cavity 15 through a gap between the contact part 54 and the front through-hole 14*a*, the dust, moisture, gas, and the like cannot enter the peripheral space of the axis part 52, that is, the space in the center hole 32. In addition, the rear end face 34*a* of the second sealing member 34 functions as the second sealing face and is pressed against the bottom face 18*a* of the front recess part 18, which securely provides sealing contact between the elastic cylindrical member 31 and the base part 11, such that even when dust, moisture, gas, and the like that exist in the space in front of the base part 11 enter a gap between the outer circumferential face of the contact part 16 and the inner circumferential face of the front recess part 18, the dust, moisture, gas, and the like cannot enter the peripheral space of the axis part 52. Thus, the dust, moisture, gas, and the like do not enter the space in rear of the base part 11 through a gap between the rear end proximity part 52*b* of the axis part 52 and the rear through-hole 11*a* of the base part 11, In addition, for example, when the outer diameter of the elastic cylindrical member 31 is slightly smaller than the inner diameter of the terminal storage cavity 15, the interior of the terminal storage cavity 15 is provided as if it were filled with the elastic cylindrical member 31 having thickness, and thus the seal ability in the terminal storage cavity 15 is improved, and the dust, moisture, gas, and the like can be efficiently blocked.

Next, a state where the connector 1 is connected to the mating connector 101 will be described.

Figure 10A:
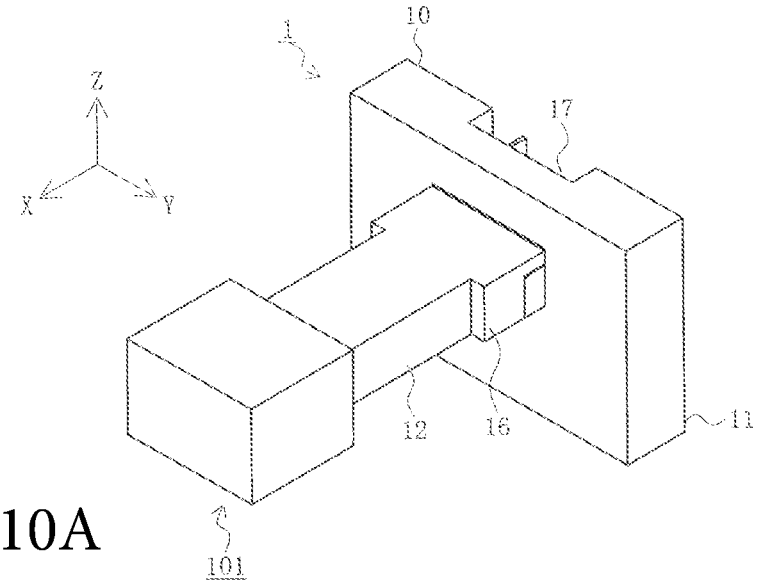
FIGS. 10A and 10B are perspective views of a state where the connector and the mating connector of the first embodiment are connected, and herein.
Figure 10B:
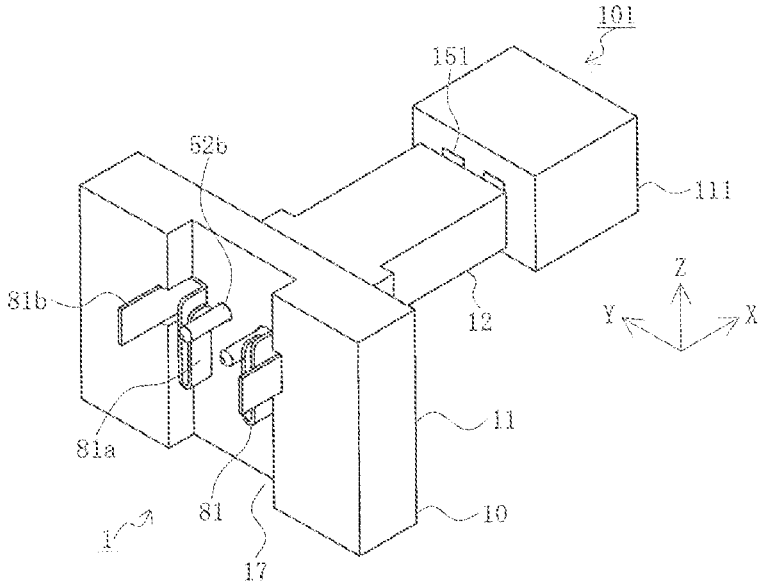
Figure 11A:
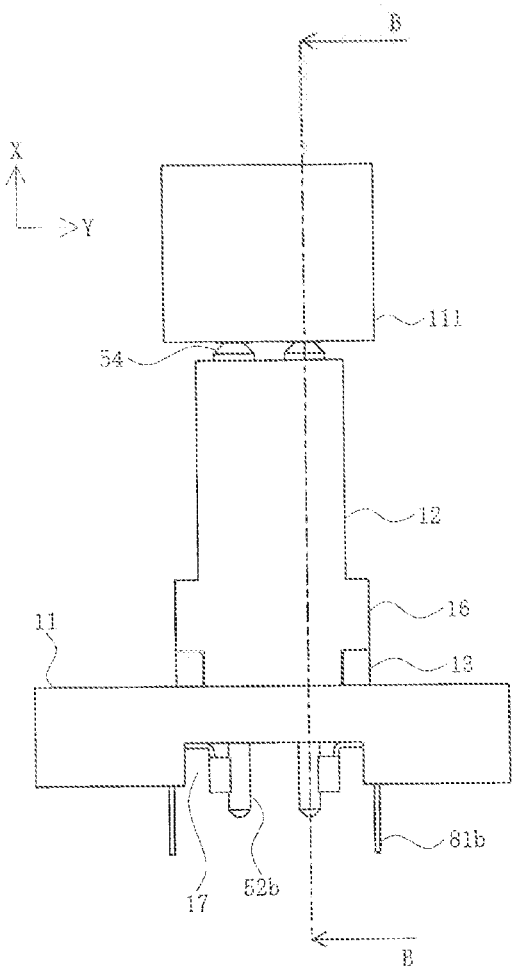
FIGS. 11A and 11B are two-way views of a state where the connector and the mating connector of the first embodiment are connected, and herein.
Figure 11B:
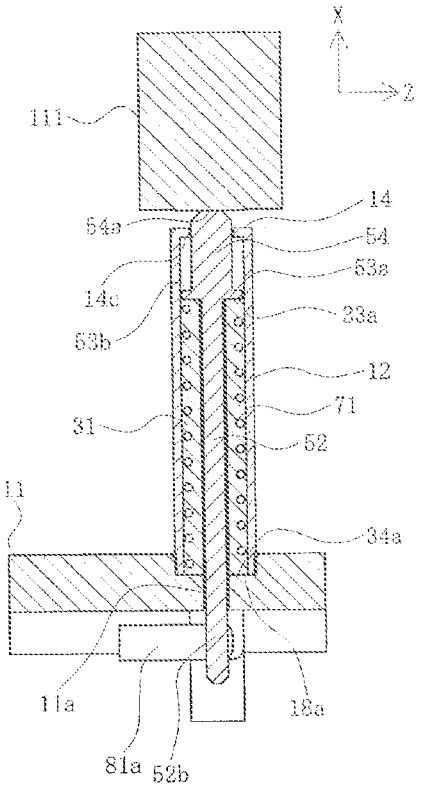
Figure 12:
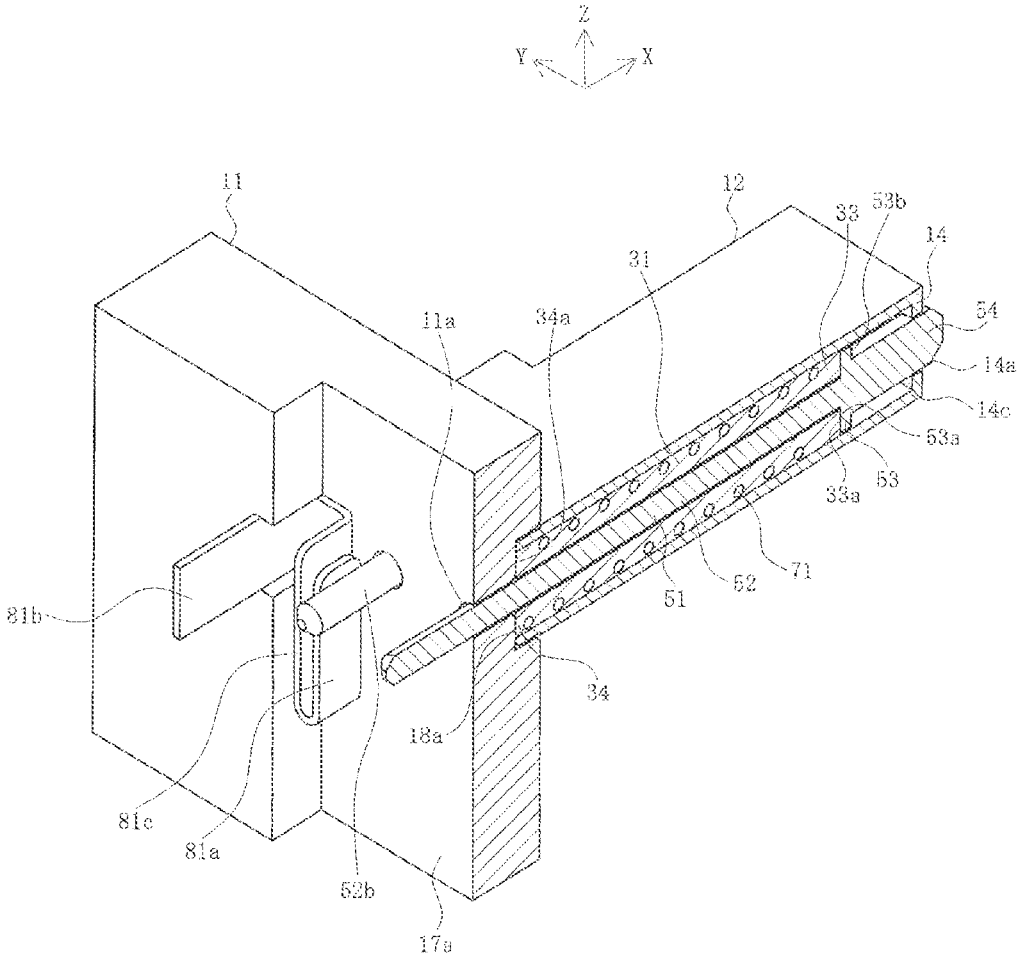
FIG. 12 is a partial cross-sectional view of the connector connected to the mating connector in the first embodiment.

FIGS. 10A and 10B are perspective views of a state where the connector and the mating connector of the first embodiment are connected, FIGS. 11A and 11B are two-way views of a state where the connector and the mating connector of the first embodiment are connected, and FIG. 12 is a partial cross-sectional view of the connector connected to the mating connector in the first embodiment. Note that, in FIGS. 10A and 10B, FIG. 10A is a view viewed from a diagonal front, and FIG. 10B is a view viewed from a diagonal rear, and in FIGS. 11A and 11B, FIG. 11A is a lower face view, and FIG. 11B is a cross-sectional side view which is a cross-sectional view taken along a line B-B of FIG. 11A.

In the present embodiment, the connector in a state of being apart from the mating connector 101, as illustrated in FIGS. 1A and 1B and 2A and 2B, relatively comes close to the mating connector 101, and then is brought into a state of being connected to the mating connector 101, as illustrated in FIGS. 10A and 10B and 11A and 11B. When the connector 1 is connected to the mating connector 101, the front end 54*a* of the contact part 54 of the terminal 51 is in a state of being pressed against the mating terminal 151 of the mating connector 101, such that the front plate part 14 of the terminal storage case 12 of the housing 10 comes close to the mating housing 111, and the terminal 51 is slid with respect to the housing 10 and relatively displaced to the rear. In this case, the slide amount of the terminal 51 to the rear, for example, is approximately 1.5 [mm], however, this can be changed as appropriate.

Subsequently, the contact part 54 is slid backward in the front through-hole 14*a* of the front plate part 14, and the protrusion amount of the front end 54*a* of the contact part 54 from the front end face 14*b* of the front plate part 14 is reduced, while the flange 53 is slid backward in the terminal storage cavity 15. Thus, the front face 53*b* of the flange 53 is separated backward from the rear face 14*c* of the front plate part 14, which creates a gap between the front face 53*b* of the flange 53 and the rear face 14*c* of the front plate part 14. In addition, the axis part 52 of the terminal 51 slides backward, and the rear end proximity part 52*b* slides backward in the rear through-hole 11*a* of the base part 11, such that the protrusion amount of the rear end proximity part 52*b* from the bottom face 17*a* of the rear recess part 17 of the base part 11 is increased. Note that, when the rear end proximity part 52*b* slides backward, the side face of the rear end proximity part 52*b* protruding from the bottom face 17*a* continues to be in sliding contact with the contact piece 81*a* of the conduction metal fitting 81, thereby maintaining the contact with the conduction metal fitting 81.

Further, the front end face 33*a* of the elastic cylindrical member 31 is displaced backward by the flange 53 that slides backward in the terminal storage cavity 15, and thus the elastic cylindrical member 31 that is integrated with the coil spring TI is further compressed in the front-and-rear direction. Consequently, the spring force exerted by the coil spring 71 increases, and the front end 54*a* of the contact part 54 of the terminal 51 is strongly pressed against the mating terminal 151 of the mating connector 101, such that a conduction state between the terminal 51 and the mating terminal 151 is steadily maintained. In addition, force with which the front end and the rear end of the coil spring 71 presses the first sealing member 33 and the second sealing member 34 further increases, the front end face 33*a* as the first sealing face is further pressed to the rear face 53*a* of the flange 53 and provides sealing contact between the elastic cylindrical member 31 and the flange 53, and the rear end face 34*a* as the second sealing face is further pressed to the bottom face 18*a* of the front recess part 18 and provides sealing contact between the elastic cylindrical member 31 and the base part 11. Thus, the sealing function of the first sealing member 33 and the second sealing member 34 is improved, and the entry of the dust, moisture, gas, and the like can be efficiently blocked. In addition, the elastic cylindrical member 31 is compressed in the front-and-rear direction, which increases the outer diameter thereof and reduces the inner diameter of the center hole 32, such that the interior of the terminal storage cavity 15 is provided as if it were filled with higher density by the elastic cylindrical member 31, and the dust, moisture, gas, and the like can be efficiently blocked.

Thus, in the present embodiments, the connector 1 includes: the housing 10 that includes the base part 11 where the rear through-hole 11*a* is formed, and the terminal storage case 12 in which the rear end thereof is connected to the base part 11, and which includes the front plate part 14 where the front through-hole 14*a* is formed; the terminal 51 that includes the axis part 52, the contact part 54 connected to the tip end of the axis part 52, and the flange 53 disposed at the boundary part between the contact part 54 and the axis part 52, wherein the rear end proximity part 52*b* of the axis part 52 is slidably inserted into the rear through-hole 11*a*, and the conduction metal fitting 81 is connected to the part that protrudes backward with respect to the bottom face 17*a* of the rear recess part 17 of the base part 11 in the rear end proximity part 52*b*, and the contact part 54 is slidably inserted into the front through-hole 14*a*, and the front end 54*a* of the contact part 54 that protrudes forward with respect to the front plate part 14 is contactable with the mating terminal 151 of the mating connector 101; the coil spring 71 that is mounted on the circumference of the axis part 52 and energizes the flange 53 forward; and the elastic cylindrical member 31 that includes the first sealing member 33 interposed between the tip end of the coil spring 71 and the flange 53, the second sealing member 34 interposed between the rear end of the coil spring 71 and the base part 11, and the central cylinder 35 for connecting the first sealing member 33 and the second sealing member 34.

Thus, the connector 1 is capable of simplifying structure, facilitating assembly, achieving low cost, steadily maintaining liquid-tightness and airtightness, and providing sealing contact between the front and the rear of the base part 11 with airtightness and liquid-tightness. In addition, the terminal 51 can be slidably held, and further a conduction state with respect to the mating terminal 151 of the mating connector 101 can be steadily maintained. Thus, reliability can be improved.

In addition, the rear end face 34*a* of the second sealing member 34 is pressed against the bottom face 18*a* of the front recess part 18 of the base part 11, thereby providing sealing contact between the rear end face 34*a* and the bottom face 18*a* of the front recess part 18. Consequently, even when dust, moisture, gas, and the like that exist in the space in front of the base part 11 enter a gap between the rear end of the terminal storage case 12 and the front recess part 18, the dust, moisture, gas, and the like cannot enter the peripheral space of the axis part 52. Thus, liquid-tightness and airtightness are steadily maintained, thereby preventing the dust, moisture, gas, and the like from entering the space in rear of the base part 11 through a gap between the rear end proximity part 52*b* of the axis part 52 and the rear through-hole 11*a* of the base part 11.

Further, the front end face 33*a* of the first sealing member 33 is pressed against the rear face 53*a* of the flange 53, thereby providing sealing contact between the front end face 33*a* and the rear face 53*a*. Consequently, even when the dust, moisture, gas, and the like that exist in the space in front of the base part 11 make an entry through a gap between the contact part 54 and the front through-hole 14*a*, the dust, moisture, gas, and the like cannot enter the peripheral space of the axis part 52. Thus, liquid-tightness and airtightness are steadily maintained, thereby preventing the dust, moisture, gas, and the like from entering the space in rear of the base part 11 through a gap between the rear end proximity part 52*b* of the axis part 52 and the rear through-hole 11*a* of the base part 11. In addition, the front end face 33*a* of the first sealing member 33 is pressed against the rear face 53*a* without sliding with the rear face 53*a* of the flange 53 and provides sealing contact between the front end face 33*a* and the rear face 53*a*, which prevents the front end face 33*a* of the first sealing member 33 from being worn by the sliding and effectively prevents the deterioration of the sealing function.

Further, the coil spring 71 is embedded in the elastic cylindrical member 31, the front part of the elastic cylindrical member 31 with respect to the front end of the coil spring 71 is the first sealing member 33, and the rear part of the elastic cylindrical member 31 with respect to the rear end of the coil spring 71 is the second sealing member 34. Consequently, it is easy to handle the coil spring 71, which facilitates the assembly of the connector 1, and thus the manufacturing cost can be reduced.

Further, the elastic cylindrical member 31 having an outer diameter thereof that is constant across the entire length is a cylindrical member and includes the center hole 32 extended in the front-and-rear direction, and the terminal 51 and the elastic cylindrical member 31 are assembled in such a manner that the axis part 52 is stored in the center hole 32, and are stored in the terminal storage cavity 15 of the terminal storage case 12. Thus, the operation of storing the terminal 51 and the elastic cylindrical member 31 in the terminal storage cavities 15 is facilitated, and the assembly of the connector 1 is facilitated, and thus the manufacturing cost can be reduced.

Further, the preload is applied to the coil spring 71 in a state where the front end 54*a* of the contact part 54 is not in contact with the mating terminal 151 of the mating connector 101, the front end face 33*a* of the first sealing member 33 is pressed against the rear face 53*a* of the flange 53, and the rear end face 34*a* of the second sealing member 34 is pressed against the bottom face 18*a* of the front recess part 18 of the base part 11. Thus, even when the connector 1 is in a state before being connected to the mating connector 101, the contact between the front end face 33*a* of the first sealing member 33 and the rear face 53*a* of the flange 53 and the contact between the rear end face 34*a* of the second sealing member 34 and the bottom face 18*a* of the front recess part 18 of the base part 11 are securely sealed, thereby providing sealing contact between the front and the rear of the base part 11 with airtightness and liquid-tightness.

Next a second embodiment will be described. Note that the description of objects having the same structures as those of the first embodiment will be omitted by being denoted by the same reference numerals. Furthermore, the description of operations and effects that are the same as those of the first embodiment will be omitted.

Figure 13A:
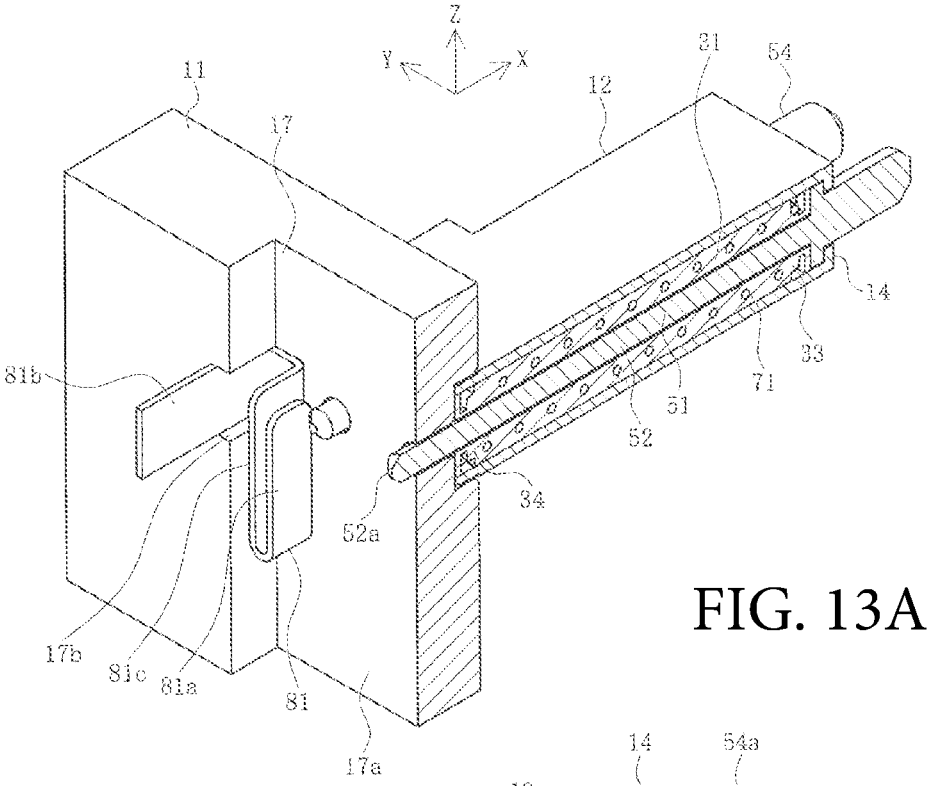
FIGS. 13A and 13B are partial cross-sectional views of a connector of a second embodiment, and herein.
Figure 13B:
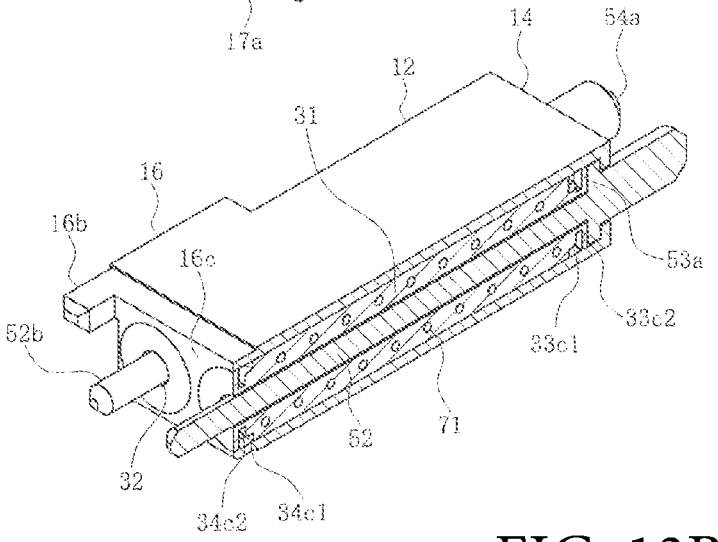
Figure 14A:
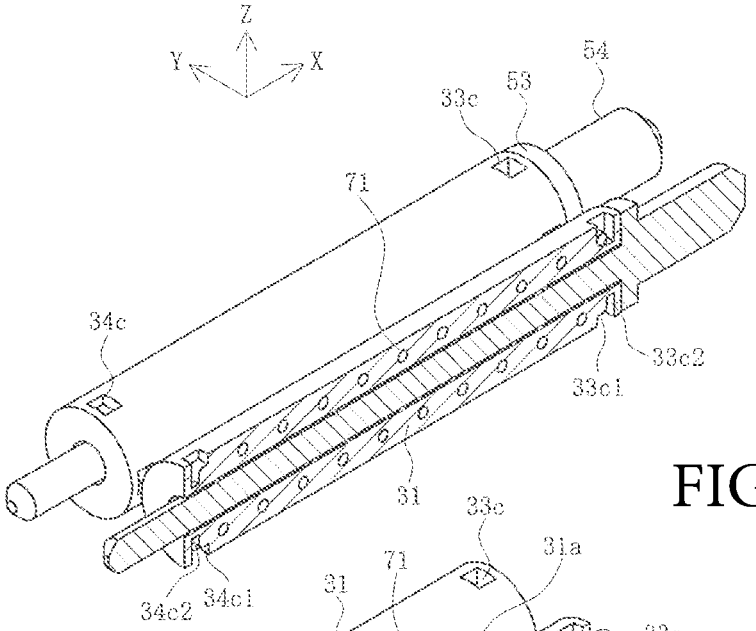
FIGS. 14A through 14C are views illustrating a state where members are removed from FIGS. 13A and 13B, and herein.
Figure 14B:
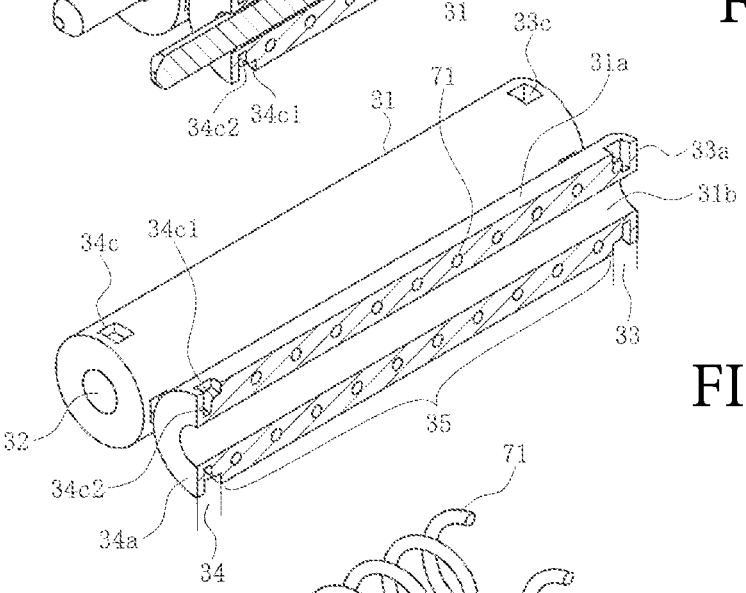
Figure 14C:
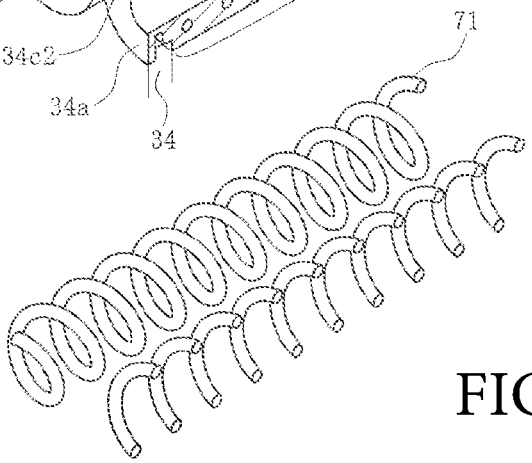
Figure 15:
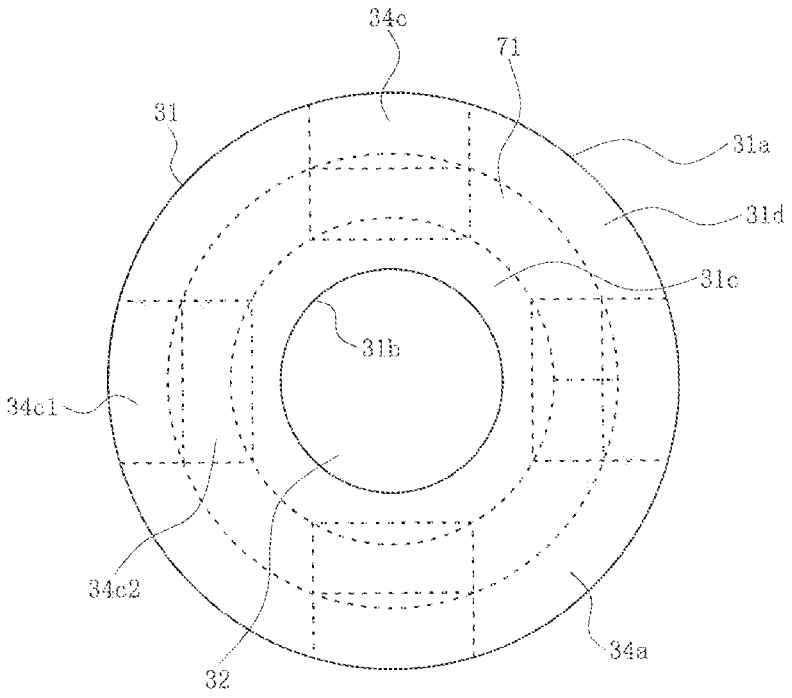
FIG. 15 is a rear face view of the elastic cylindrical member of the second embodiment.

FIGS. 13A and 13B are partial cross-sectional views of a connector of the second embodiment, FIGS. 14A through 14C are views illustrating a state where members are removed from FIGS. 13A and 13B, and FIG. 15 is a rear face view of the elastic cylindrical member of the second embodiment. Note that, in FIGS. 13A and 13B, FIG. 13A is a partial cross-sectional view of a connector viewed from a diagonal rear, and FIG. 13B is a view illustrating a state where a base part is removed from FIG. 13A, and in FIGS. 14A through 14C, FIG. 14A is a view illustrating a state where a terminal storage case is removed from FIG. 13B, FIG. 14B is a view illustrating a state where a terminal is removed from FIG. 14A, and FIG. 14C is a view illustrating a state where an elastic cylindrical member is removed from FIG. 14B.

In the first embodiment, the coil spring 71 comes close to the outer circumferential face 31*a* of the elastic cylindrical member 31, or as in the modified example illustrated in FIGS. 9A and 9B, the part of the outer circumferential face of the coil spring 71 is exposed to the outer circumferential face 31*a* of the elastic cylindrical member 31, however, in the present embodiment, the coil spring 71 separates from the outer circumferential face 31*a* of the elastic cylindrical member 31 and is positioned between the outer circumferential face 31*a* and the inner circumferential face 31*b*. Note that, in the example illustrated in FIG. 15, when the coil spring 71 is observed from the front-and-rear direction (X-axis direction) of the elastic cylindrical member 31, the coil spring 71 is positioned in the middle of the outer circumferential face 31*a* and the inner circumferential face 31*b* in the radial direction of the elastic cylindrical member 31, however, the coil spring 71 is not necessarily positioned in the middle of the outer circumferential face 31*a* and the inner circumferential face 31*b*, and the coil spring 71 may separate from the outer circumferential face 31*a* and the inner circumferential face 31*b* and may be positioned between the outer circumferential face 31*a* and the inner circumferential face 31*b*. That is, the elastomer as the material of the elastic cylindrical member 31 is only required to be present on both inside and outside of the coil spring 71 in the radial direction of the elastic cylindrical member 31. Note that FIG. 15 illustrates a state viewed from the rear of the elastic cylindrical member 31, that is, the rear end face 34*a*, however, the same is applied to a state viewed from the front of the elastic cylindrical member 31, that is, the front end face 33*a*.

In a state where the connector 1 is connected to the mating connector 101, and the elastic cylindrical member 31 that is integrated with the coil spring 71 is compressed in the front-and-rear direction, when the connector 1 and the mating connector 101 are cooled to approximately room temperatures after being placed under the environment of a relatively high temperature (e.g., about 85 degrees Celsius or higher), the connection between the connector 1 and the mating connector 101 is released, and the elastic cylindrical member 31 returns to the original length thereof by the spring force of the coil spring 71, the flatness of the front end face 33*a* and/or the rear end face 34*a* of the elastic cylindrical member 31 may be reduced. Conceivably, this is because when the elastomer being the material of the elastic cylindrical member 31 is cooled, the elastomer that hardens to a certain degree in a state of being compressed in the front-and-rear direction is forcibly returned to the original length thereof by the spring force of the coil spring 71.

Thus, in the present embodiment, as described above, the elastomers being the material of the elastic cylindrical member 31 are disposed on both inside and outside of the coil spring 71. That is, as illustrated in FIG. 15, the elastic cylindrical member 31 includes an inside section 31*c* positioned on the inside of the coil spring 71 and an outside section 31*d* positioned on the outside of the coil spring 71. Thus, the elastomers on both inside and outside of the coil spring 71, that is, the elastomers of the inside section 31*c* and the outside section 31*d* are uniformly returned to the original lengths thereof by the spring force of the coil spring 71, such that the reduction in the flatness of the front end face 33*a* and/or the rear end face 34*a* of the elastic cylindrical member 31 can be prevented.

In the aforementioned description, the state "hardens to a certain degree in a state of being compressed in the front-and-rear direction" can be said as a compression permanent set under the high-temperature environment, however, there is no limitation thereto, and a compression permanent set under any condition such as a room-temperature, or low-temperature condition can be applied.

In order to uniformly dispose the elastomers on both the inside section 31*c* and the outside section 31*d* as much as possible, for example, as illustrated in FIG. 15, at the radius of the elastic cylindrical member 31, the length of a part corresponding to the inside section 31*c* may match the length of a part corresponding to the outside section 31*d*, or the volumes (the corresponding areas in FIG. 15) of the elastomers on both the inside section 31*c* and the outside section 31*d* may be equalized.

Note that in the example illustrated in FIGS. 13A and 13B and 14A through 14C, the elastomers are disposed on both inside and outside of the coil spring 71 across the entire length of the elastic cylindrical member 31, however, as long as the elastomers are disposed on both inside and outside of the coil spring 71 only in the vicinity of the front end face 33*a* and the vicinity of the rear end face 34*a*, that is, only the first sealing member 33 and the second sealing member 34, or only in the vicinity of the first sealing member 33 and in the vicinity of the second sealing member 34 the elastomers may be disposed on only any one of the inside or the outside of the coil spring 71 in other sections.

In addition, the front recess parts 33*c* and the rear recess parts 34*c* that are formed of a plurality of protrusions formed in the cavity of the die for molding in which the elastomer of the elastic cylindrical member 31 is filled are formed at a plurality of sections on the first sealing member 33 and the first sealing member 33 of the elastic cylindrical member 31, and the front end and the rear end of the coil spring 71 are exposed on any of the front recess parts 33*c* and any of the rear recess parts 34*c*. In the present embodiment, the coil spring 71 is not exposed to and not in proximity to the outer circumferential face 31*a* of the elastic cylindrical member 31, such that the outer circumferential face of the coil spring 71 cannot be supported by the cylindrical inner circumferential face of the cavity to mold the elastic cylindrical member 31. Accordingly, in the present embodiment, the protrusions include a shape capable of abutting both ends in the axial direction and the outer circumferential face of the coil spring 71, to position the coil spring 71 in a state of being embedded in the interior of the elastomer. Consequently, the front recess parts 33*c* and the rear recess parts 34*c* formed of the protrusions are formed as a stepped recess part that includes upper bottom parts 33*c*1 and 34*c*1 being relatively shallow parts and lower bottom parts 33*c*2 and 34*c*2 being relatively deep parts. Moreover, as illustrated in FIGS. 14A through 14C, the front end of the coil spring 71 in the axial direction is in a state of being exposed on the upper bottom part 33*c*1 of any one of the front recess parts 33*c*, and the rear end of the coil spring 71 in the axial direction is in a state of being exposed on the upper bottom part 34*c* 1 of any one of the rear recess parts 34*c*. Note that the front recess parts 33*c* and the rear recess parts 34*c* of the present embodiment are not opened to the front end face 33*a* and the rear end face 34*a* of the elastic cylindrical member 31.

Thus, in the present embodiment, a part including at least the first sealing member 33 and a part including at least the second sealing member 34 in the elastic cylindrical member 31 include the inside section 31*c* positioned inside the coil spring 71 and the outside section 31*d* positioned outside the coil spring 71. In addition, the inside section 31*c* and the outside section 31*d* are cylindrical. Further, the area of the cross-sectional face of the inside section 31*c* and the area of the cross-sectional face of the outside section 31*d* can be equalized.

Consequently, the elastomers of the inside section 31*c* and the outside section 31*d* are uniformly returned to the original lengths thereof by the spring force of the coil spring 71, such that the reduction in the flatness of the front end face 33*a* and/or the rear end face 34*a* of the elastic cylindrical member 31 can be prevented.

It should be noted that descriptions of configurations and operations of other aspects of the connector 1 and the mating connector 101 that are identical to those of first embodiment will be omitted.

Next, a third embodiment will be described. It should be noted that the description of objects having the same structure as the first and second embodiments will be omitted by denoting said objects by the same symbols. Furthermore, descriptions of operations and effects that are the same as those of the first and second embodiments will also be omitted.

Figure 16A:
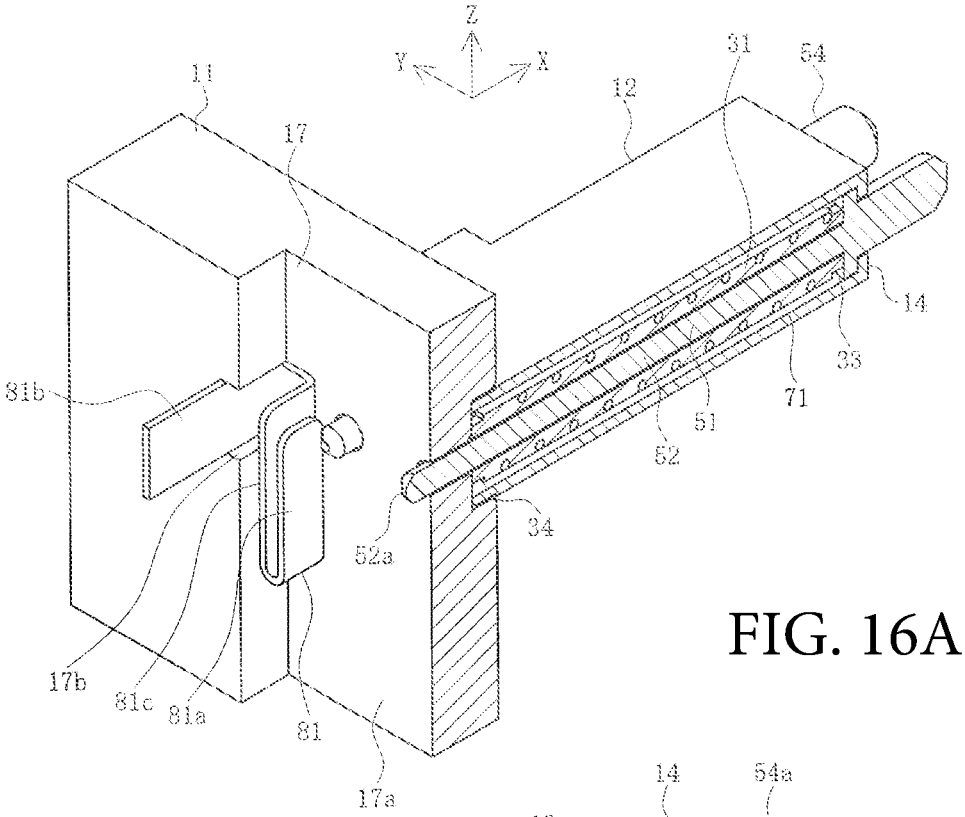
FIGS. 16A and 16B are partial cross-sectional views of a connector of a third embodiment, and herein.
Figure 16B:
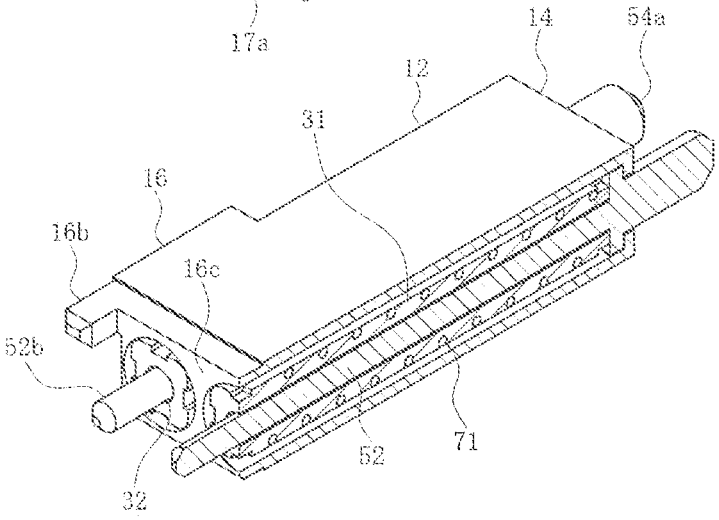
Figure 17A:
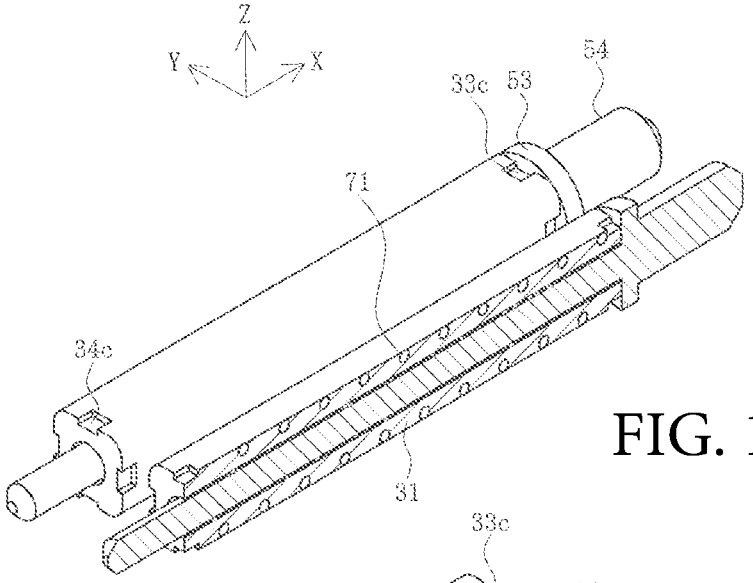
FIGS. 17A through 17C are views illustrating a state where members are removed from FIGS. 16A and 16B, and herein.
Figure 17B:
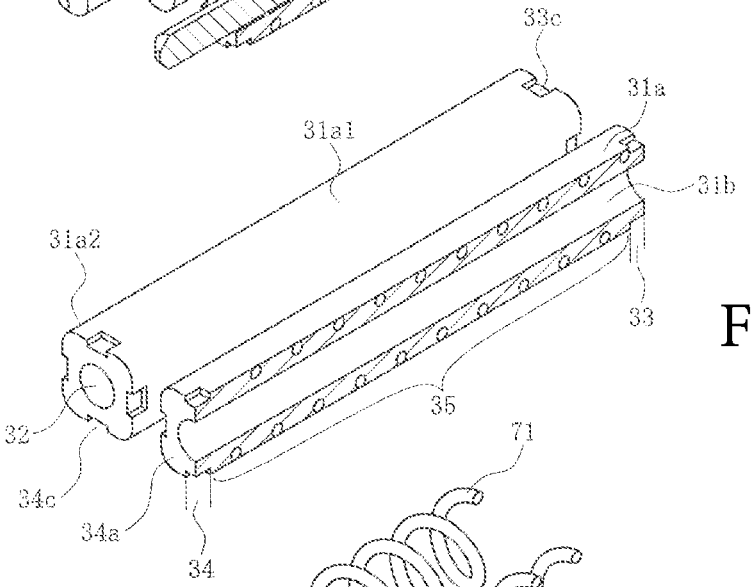
Figure 17C:
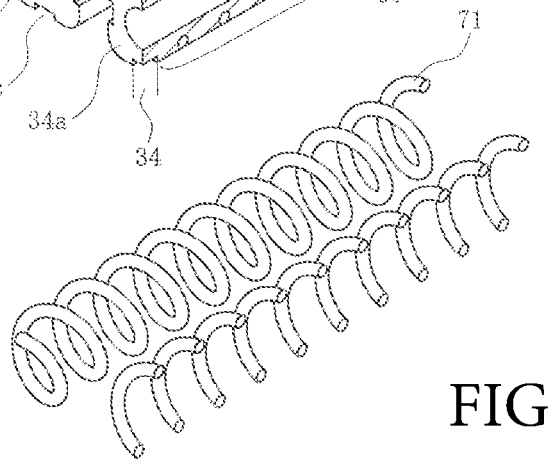
Figure 18:
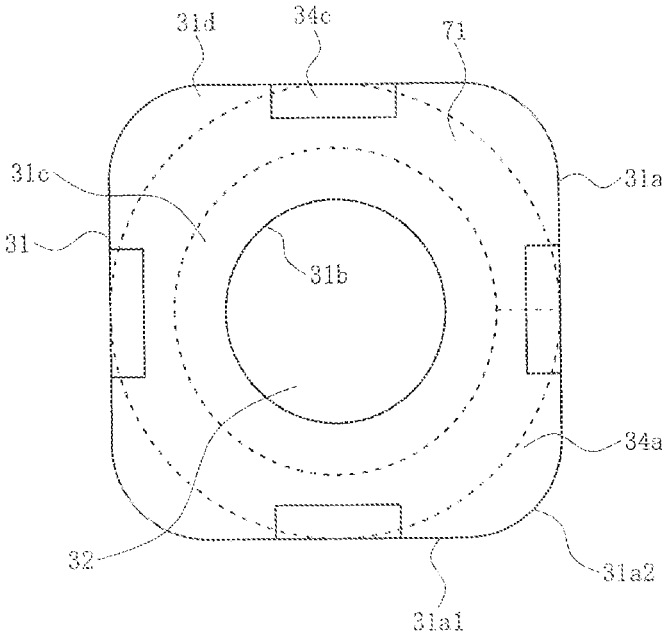
FIG. 18 is a rear face view of the elastic cylindrical member of the third embodiment.

FIGS. 16A and 16B are partial cross-sectional views of a connector of the third embodiment, FIGS. 17A through 17C are views illustrating a state where members are further removed from FIGS. 16A and 16B, and FIG. 18 is a rear face view of the elastic cylindrical member of the third embodiment. Note that, in FIGS. 16A and 16B, FIG. 16A is a partial cross-sectional view of a connector viewed from a diagonal rear, and FIG. 16B is a view illustrating a state where a base part is removed from FIG. 16A, and in FIGS. 17A through 17C, FIG. 17A is a view illustrating a state where a terminal storage case is removed from FIG. 16B, FIG. 17B is a view illustrating a state where a terminal is removed from FIG. 17A, and FIG. 17C is a view illustrating a state where an elastic cylindrical member is removed from FIG. 17B.

In the first and second embodiments, the elastic cylindrical member 31 is a cylindrical member, and the outer circumferential face 31*a* is a columnar face (cylindrical face) having a cross-sectional face that is a circle, however, in the present embodiment, the elastic cylindrical member 31 includes the center hole 32 having a cross section that is a circle, and the outer circumferential face 31*a* is a rectangular columnar face having a cross-sectional face that is approximately a regular square. Specifically, the outer circumferential face 31*a* includes four elongate planes 31*a*1 extended in the front-and-rear direction and four elongate curved faces 31*a*2 curved at 90 degrees that couple the long sides of the adjacent elongate planes 31*a*1.

The elastic cylindrical member 31 includes the inside section 31*c* positioned on the inside of the coil spring 71 and the outside section 31*d* positioned on the outside of the coil spring 71, however as illustrated in FIG. 18, in the present embodiment, the outside section 31*d* is provided only with four curved faces 31*a*2 and parts in the the vicinity thereof on the outer circumferential face 31*a*. Moreover, the coil spring 71 comes close to the four elongate planes 31*a*1 on the outer circumferential face 31*a*. That is, when viewed from the front or the rear of the elastic cylindrical member 31, the outer circumference of the coil spring 71 is an inscribed circle of the outer circumferential face 31*a* shaped in approximately a regular square.

Thus, the elastic cylindrical member 31 includes the inside section 31*c* and the outside section 31*d*, and thus the elastomers on both inside and outside of the coil spring 71, that is, the elastomers of the inside section 31*c* and the outside section 31*d* are uniformly returned to the original lengths thereof by the spring force of the coil spring 71, such that the reduction in the flatness of the front end face 33*a* and/or the rear end face 34*a* of the elastic cylindrical member 31 can be prevented. In order to uniformly dispose the elastomers on both the inside section 31*c* and the outside section 31*d* as much as possible, for example, the volumes (the corresponding areas in FIG. 18) of the elastomers on both the inside section 31*c* and the outside section 31*d* can be equalized.

In the present embodiment, the coil spring 71 is in close proximity to the planes 31*a*1 on the outer circumferential face 31*a* of the elastic cylindrical member 31, such that the outer circumferential face of the coil spring 71 can be supported by the inner circumferential face of the cavity of the die for molding the elastic cylindrical member 31. Thus, the same as with the first embodiment, a plurality of protrusions formed in the cavity is only required to have a shape capable of abutting only both ends of the coil spring 71 in the axial direction, and as a result, the front recess parts 33*c* and the rear recess parts 34*c* formed of the plurality of protrusions have the same shape as that of the first embodiment.

Note that, in the present embodiment, the outer circumferential face 31*a* of the elastic cylindrical member 31 is a rectangular columnar face having a cross-sectional face that is approximately a regular square, as illustrated in FIGS. 16A and 16B, and thus a gap is created between the circumferential face of the terminal storage cavity 15 and the outer circumferential face 31*a*. However, the same as with the first embodiment, the rear end face 34*a* of the second sealing member 34 functions as the second sealing face and is pressed against the bottom face 18*a* of the front recess part 18, which securely provides sealing contact between the elastic cylindrical member 31 and the base part 11, such that even when dust, moisture, gas, and the like that exist in the space in front of the base part 11 enter a gap between the outer circumferential face 31*a* of the elastic cylindrical member 31 and the inner circumferential face of the terminal storage cavity 15, the dust, moisture, gas, and the like do not enter the peripheral space of the axis part 52. Thus, the dust, moisture, gas, and the like do not enter the space in rear of the base part 11 through a gap between the rear end proximity part 52*b* of the axis part 52 and the rear through-hole 11*a* of the base part 11.

Thus, in the present embodiment, the inside section 31*c* is a cylindrical member, and the cross-sectional face of the outer circumferential face 31*a* of the outside section 31*d* is approximately a regular square. In addition, the area of the cross-sectional face of the inside section 31*c* and the area of the cross-sectional face of the outside section 31*d* can be equalized.

Consequently, the elastomers of the inside section 31*c* and the outside section 31*d* are uniformly returned to the original lengths thereof by the spring force of the coil spring 71, such that the reduction in the flatness of the front end face 33*a* and/or the rear end face 34*a* of the elastic cylindrical member 31 can be prevented.

It should be noted that descriptions of configurations and operations of other aspects of the connector 1 and the mating connector 101 that are identical to those of first and second embodiments will be omitted.

Next, a fourth embodiment will be described. It should be noted that descriptions of objects having the same structure as those of the first through third embodiments will be omitted by being denoted by the same reference numerals. Furthermore, likewise, descriptions will be omitted for operations and effects that are the same as those of the aforementioned first through third embodiments.

Figure 19A:
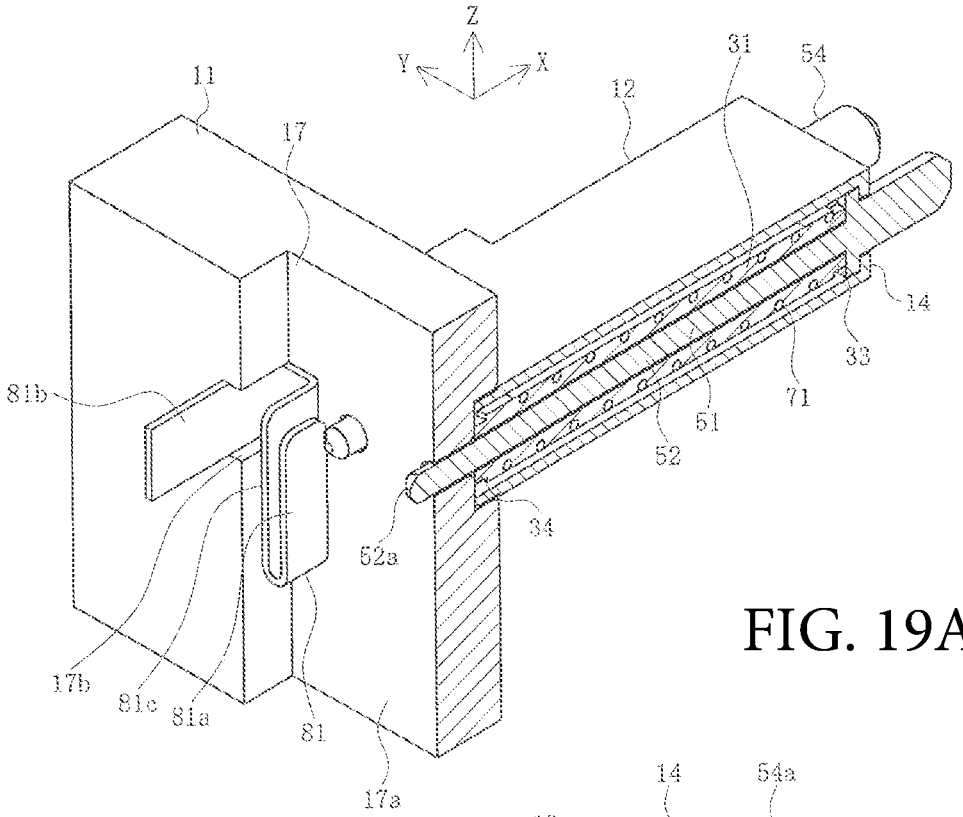
FIGS. 19A and 19B are partial cross-sectional views of a connector of a fourth embodiment, and herein.
Figure 19B:
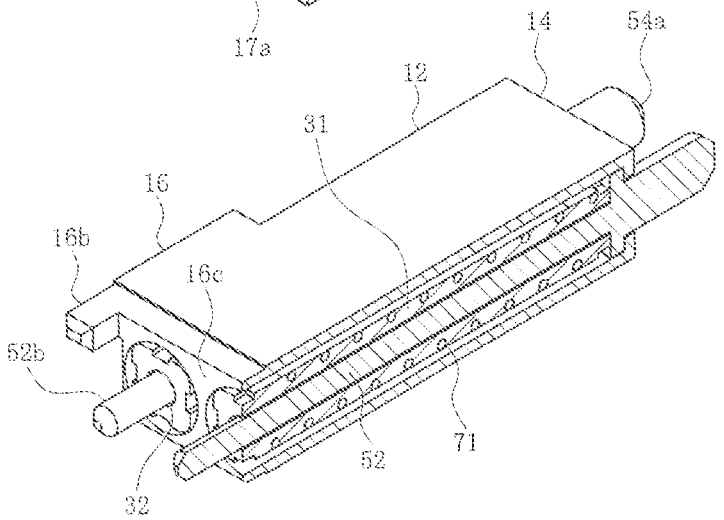
Figure 20A:
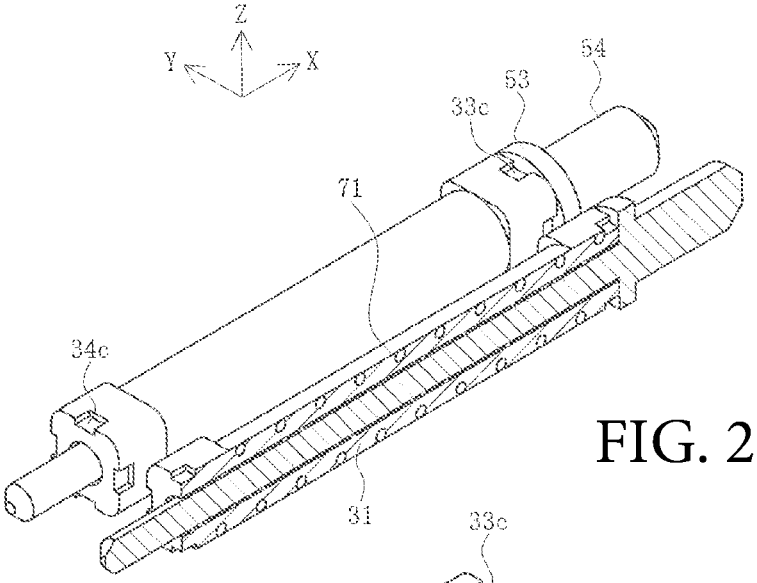
FIGS. 20A through 20C are views illustrating a state where members are removed from FIGS. 19A and 19B, and herein.
Figure 20B:
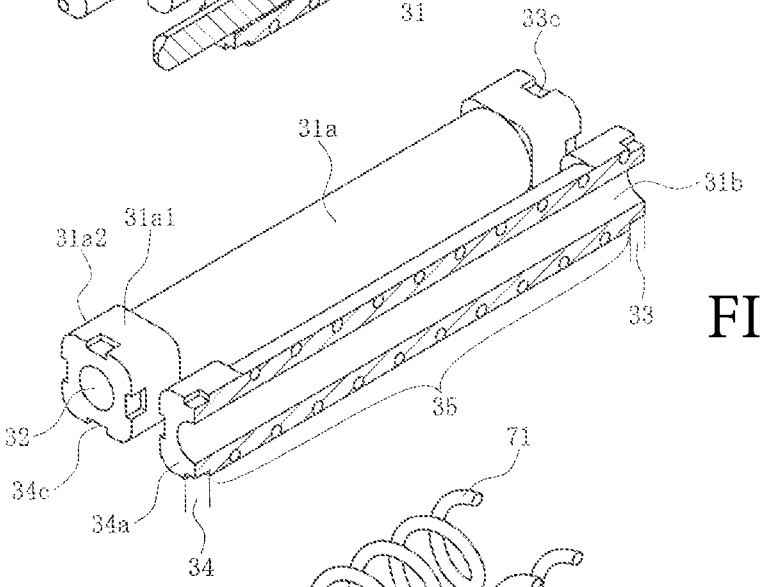
Figure 20C:
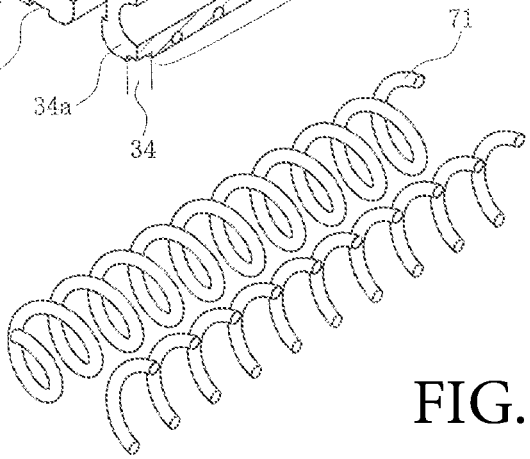

FIGS. 19A and 19B are partial cross-sectional views of a connector of the fourth embodiment, and FIGS. 20A through 20C are views illustrating a state where members are removed from FIGS. 19A and 19B. Note that, in FIGS. 19A and 19B, FIG. 19A is a partial cross-sectional view of the connector viewed from a diagonal rear, and FIG. 19B is a view illustrating a state where a base part is removed from FIG. 19A, and in FIGS. 20A through 20C, FIG. 20A is a view illustrating a state where a terminal storage case is removed from FIG. 19B, FIG. 20B is a view illustrating a state where a terminal is removed from FIG. 20A, and FIG. 20C is a view illustrating a state where an elastic cylindrical member is removed from FIG. 20B.

In the third embodiment, the cross-sectional face of the outer circumferential face 31*a* of the elastic cylindrical member 31 is a rectangular columnar face formed approximately in a regular square across the entire length of the elastic cylindrical member 31, however in the present embodiment, the cross-sectional face of the outer circumferential face 31*a* is a rectangular columnar face formed approximately in a regular square only in the vicinity of the front end face 33*a* and in the vicinity of the rear end face 34*a*, that is, only the first sealing member 33 and the second sealing member 34, or only in the vicinity of the first sealing member 33 and in the vicinity of the second sealing member 34, and in other sections, as is the same with the first embodiment, the cross-sectional face of the outer circumferential face 31*a* is a columnar face (cylindrical face).

That is, the elastic cylindrical member 31 includes the inside section 31*c* and the outside section 31*d* only in the first sealing member 33 and the second sealing member 34, or only in the vicinity of the first sealing member 33 and in the vicinity of the second sealing member 34, and the elastomers are disposed on both inside and outside of the coil spring 71, however in other sections, the elastic cylindrical member 31 does not include the outside section 31*d*, and the elastomer is disposed only on the inside of the coil spring 71.

Thus, in the present embodiment, at a part including at least the first sealing member 33 and a part including at least the second sealing member 34 in the elastic cylindrical member 31, the inside section 31*c* positioned inside the coil spring 71 is cylindrical, and the cross-sectional face of the outer circumferential face 31*a* of the outside section 31*d* positioned outside the coil spring 71 is approximately a regular square.

It should be noted that descriptions of configurations and operations of other aspects of the connector 1 and the mating connector 101 that are identical to those of the first through third embodiments will be omitted.

Next, a fifth embodiment will be described. It should be noted that descriptions of objects having the same structure as those of the first through fourth embodiments will be omitted by being denoted by the same reference numerals. Likewise, descriptions will be omitted for operations and effects that are the same as those of the aforementioned first through fourth embodiments.

Figure 21A:
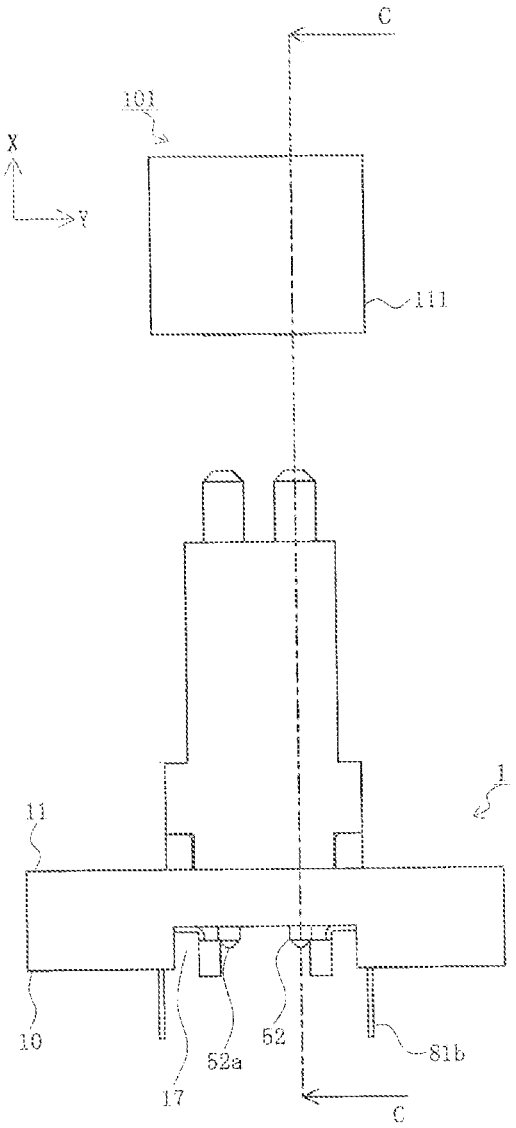
FIGS. 21A and 21B are two-way views of a connector and a mating connector of a fifth embodiment, and herein.
Figure 21B:
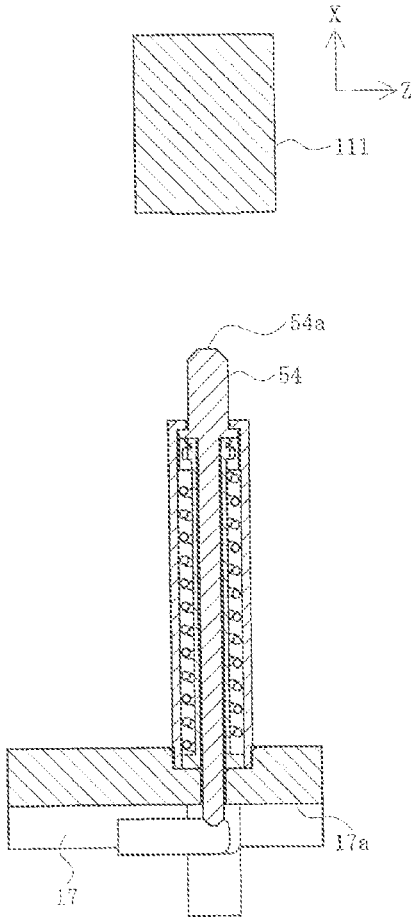
Figure 22:
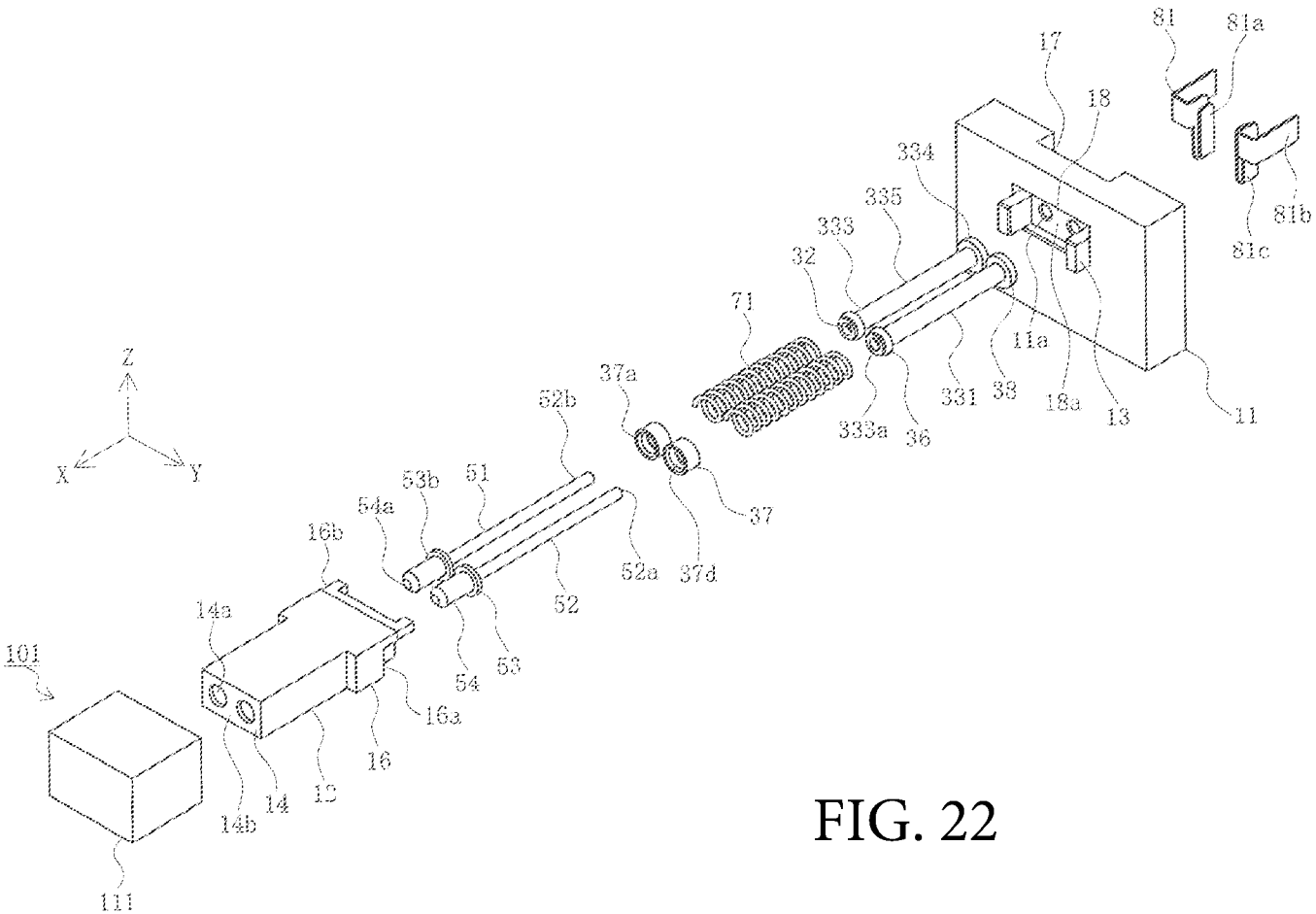
FIG. 22 is a first exploded view of the connector and the mating connector of the fifth embodiment.
Figure 23:
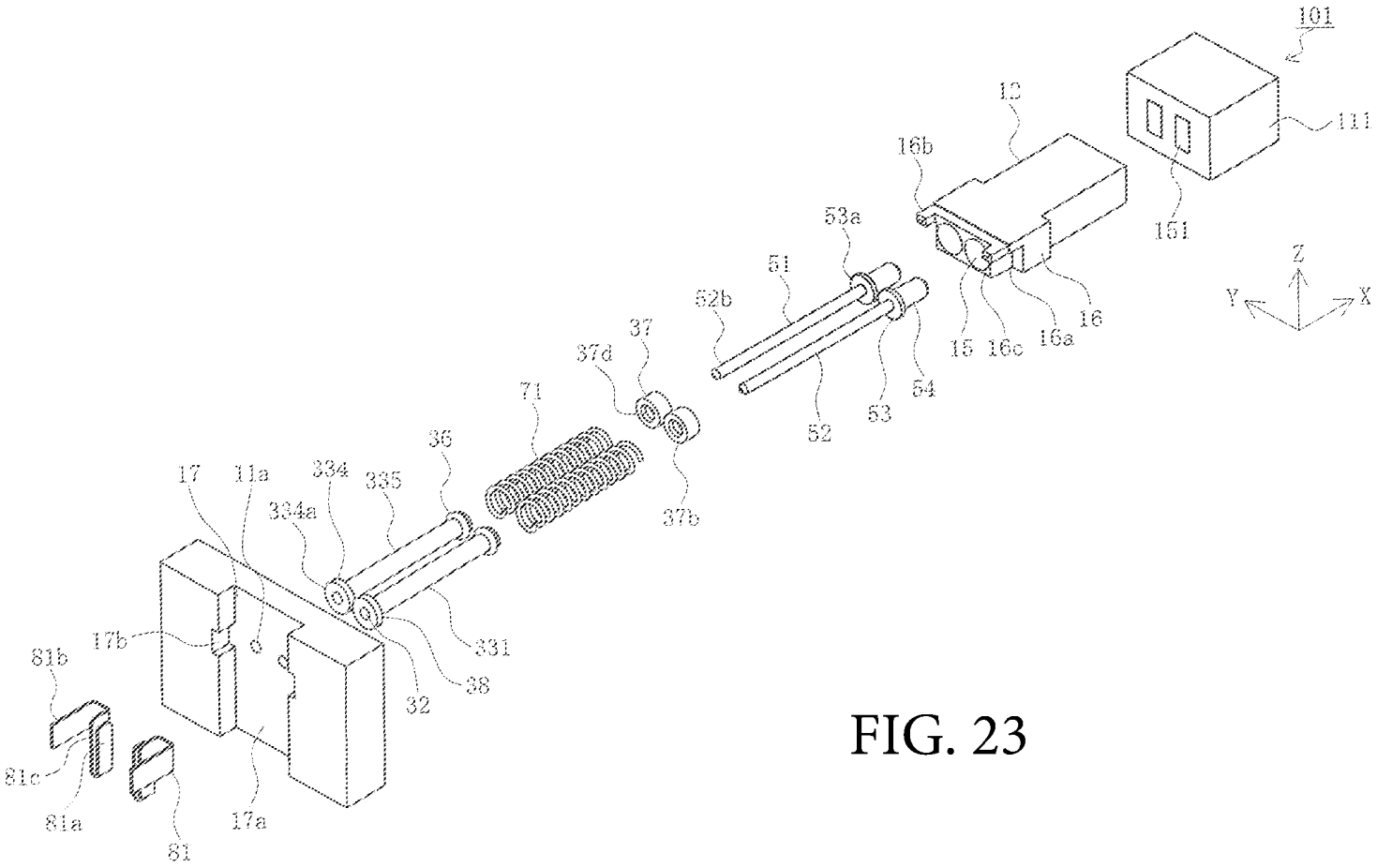
FIG. 23 is a second exploded view of the connector and the mating connector of the fifth embodiment.
Figure 24A:
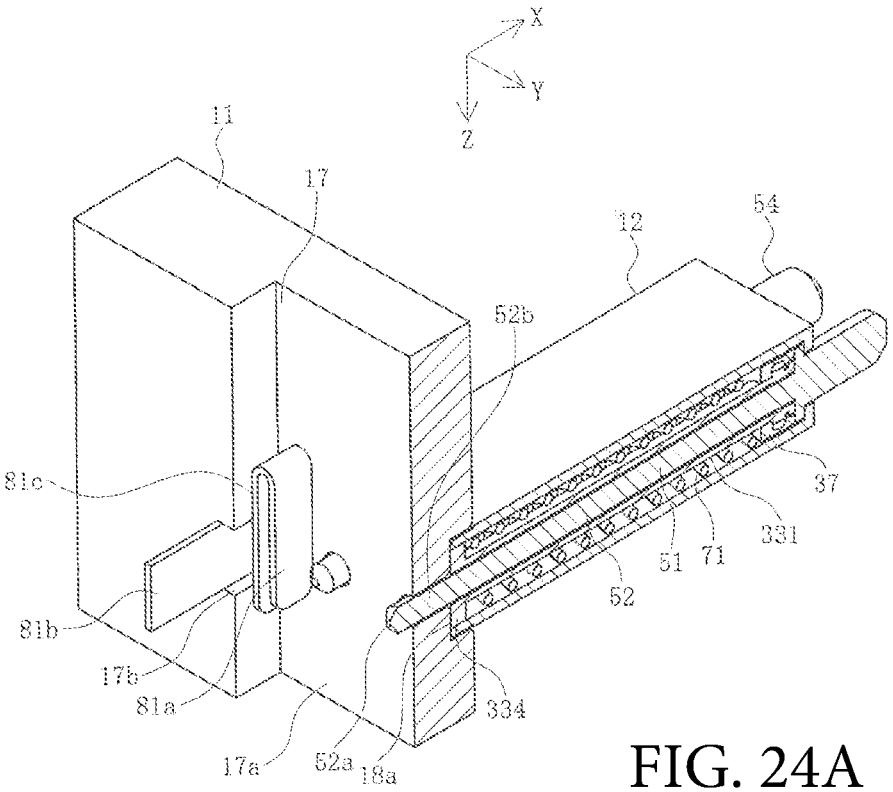
FIGS. 24A and 24B are partial cross-sectional views of a connector of the second embodiment, and herein.
Figure 24B:
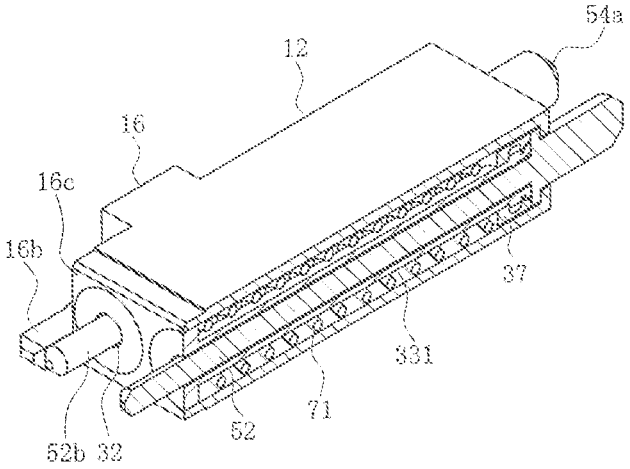
Figure 25A:
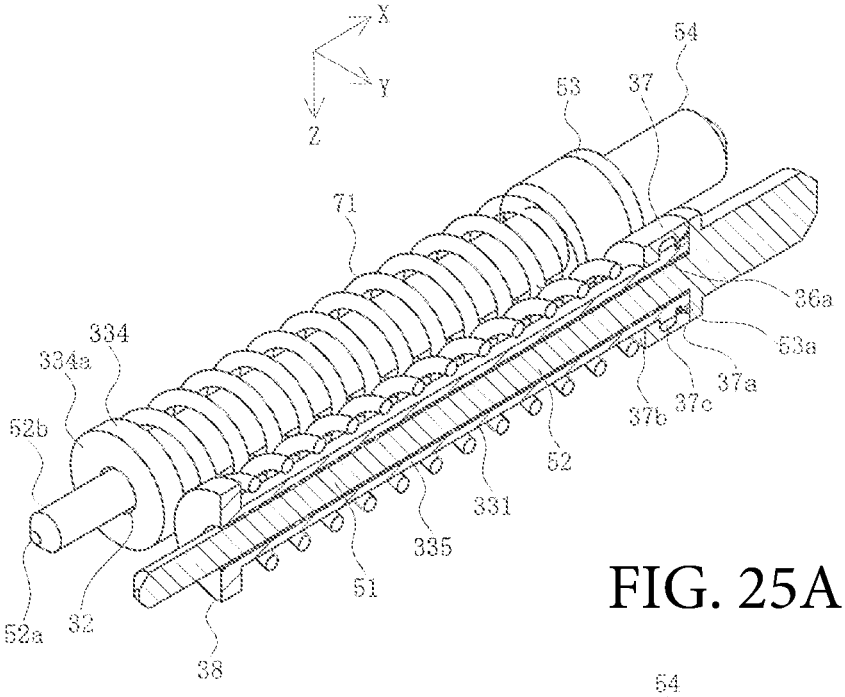
FIGS. 25A and 25B are views illustrating a state where members are removed from FIGS. 24A and 24B, and herein.
Figure 25B:
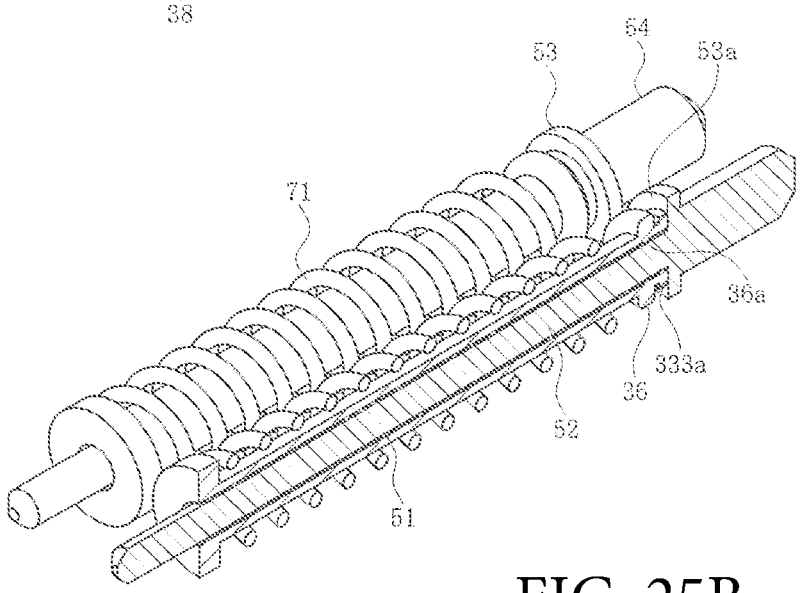
Figure 26A:
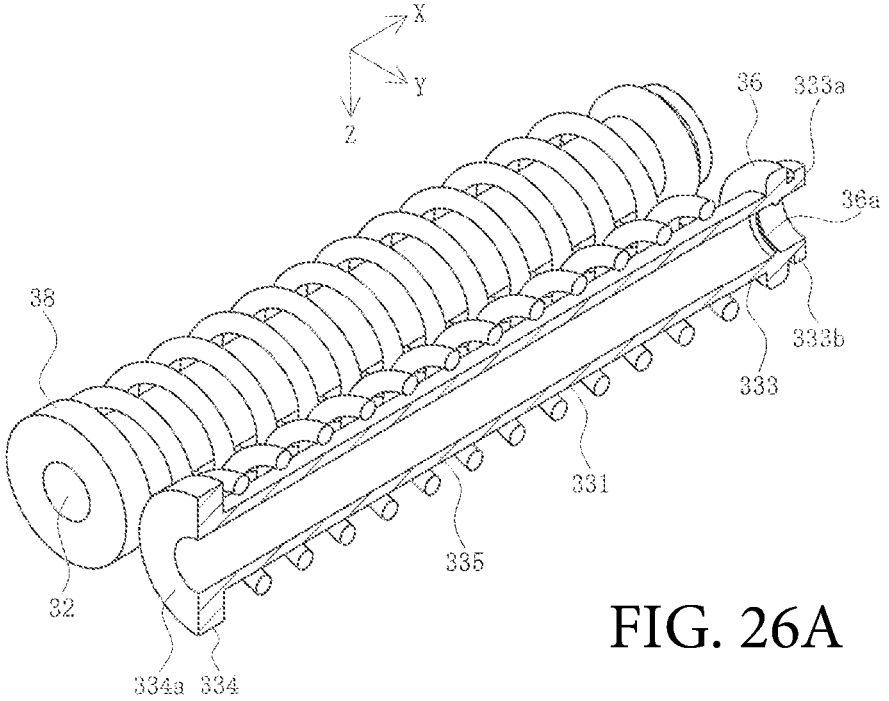
FIGS. 26A and 26B are views illustrating a state where members are further removed from FIGS. 25A and 25B, and herein.
Figure 26B:
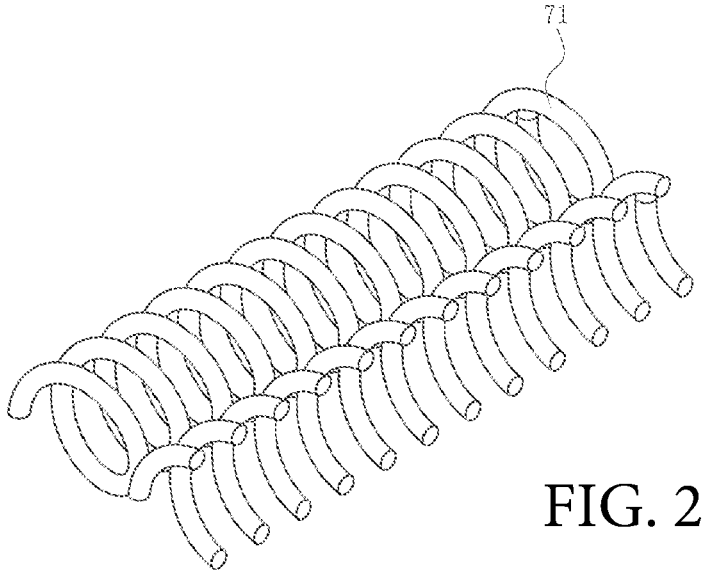
Figure 27:
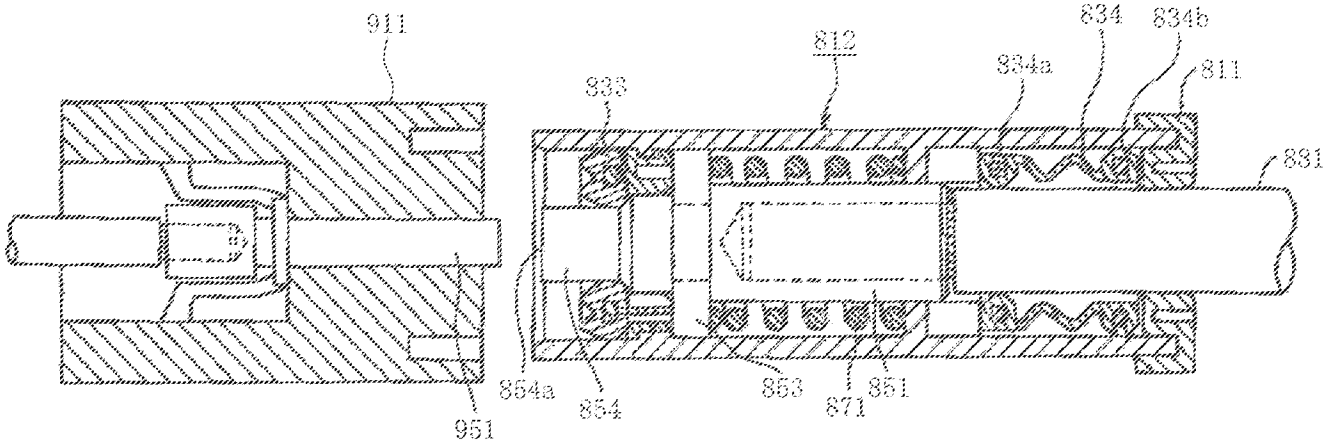
FIG. 27 Prior Art
FIG. 27 is a cross-sectional view of a conventional connector.

FIGS. 21A and 21B are two-way views of a connector and a mating connector of the fifth embodiment; FIG. 22 is a first exploded view of the connector and the mating connector of the fifth embodiment; FIG. 23 is a second exploded view of the connector and the mating connector of the fifth embodiment; FIGS. 24A and 24B are partial cross-sectional views of the connector of the fifth embodiment; FIGS. 25A and 25B are views illustrating a state where members are removed from FIGS. 24A and 24B; and FIGS. 26A and 26B are views illustrating a state where members are further removed from FIGS. 25A and 25B. Note that, in FIGS. 21A and 21B, FIG. 21A is a lower face view, and FIG. 21B is a cross-sectional side view which is a cross-sectional view taken along a line C-C of FIG. 21A; in FIGS. 24A and 24B, FIG. 24A is a partial cross-sectional view of a connector viewed from a diagonal rear, and FIG. 24B is a view illustrating a state where a base part is removed from FIG. 24A; in FIGS. 25A and 25B, FIG. 25A is a view illustrating state where a terminal storage case is removed from FIG. 24B, and FIG. 25B is a view illustrating a state where an energizing ring is removed from FIG. 25A; and in FIGS. 26A and 26B, FIG. 26A is a view illustrating a state where a terminal is removed from FIG. 25B, and FIG. 26B is a view illustrating a state where an elastic cylindrical member is removed from FIG. 26A.

In the present embodiment, an elastic cylindrical member 331 formed of the elastomer as a cylindrical member is not integrated with the metallic coil spring 71. That is, the elastic cylindrical member 331 and the coil spring 71 are separately provided. In addition, the outer diameter of the elastic cylindrical member 331 of the present embodiment is not uniform across the entire length unlike the first embodiment, the elastic cylindrical member 331 has a central cylinder 335 having an outer diameter that is smaller than the inner diameter of the coil spring 71, and a first sealing member 333 and a second sealing member 334 are integrally connected to the front and rear ends of the central cylinder 335. Note that, the same as with the first embodiment, the elastic cylindrical member 331 of the present embodiment also includes the center hole 32 having a circular cross section and extended in the front-and-rear direction, and both ends of the center hole 32 are opened on a front end face 333*a* and a rear end face 334*a*. In addition, the inner diameter of the center hole 32 is identical to that of the first embodiment.

The outer diameter of the second sealing member 334 is identical to the outer diameter of the elastic cylindrical member 31 of the first embodiment. Thus, the second sealing member 334 is a flange having a large outer diameter and formed at the rear end of the central cylinder 335 having a small outer diameter. In contrast, the outer diameter of the first sealing member 333 is identical to that of the central cylinder 335 as a whole, however, a front end flange 333*b* having a slightly large outer diameter is formed in the vicinity of the front end flange 333*b*, and a ring protrusion 36 as a larger engaging protrusion is formed in rear of the front end face 333*a*, and further a sealing ring 36*a* that protrudes to the center of the center hole 32 is formed at a section corresponding to the ring protrusion 36 on the inner circumferential face of the center hole 32. Note that the outer shape of the ring protrusion 36 is set smaller than the outer diameter of the second sealing member 334, and the outer shape of the front end flange 333*b* is set smaller than the outer shape of the ring protrusion 36.

Moreover, an energizing ring 37 as a radial-direction energizing member is mounted on the circumference of the first sealing member 333. The energizing ring 37 is a separate member from the elastic cylindrical member 331, is a cylindrical member that is molded of materials such as resin and metal that are harder than the elastomer being the material of the elastic cylindrical member 331, and the length thereof in the front-and-rear direction is short, and the energizing ring 37 includes a center hole 37*d* having a circular cross section and extended in the front-and-rear direction. Moreover, the outer diameter of the energizing ring 37 is constant across the entire length, and the outer diameter is identical to the outer diameter of the second sealing member 334. In addition, the inner diameter of the center hole 37*d* is set slightly larger than the outer diameter of the central cylinder 335, and an engaging recess groove 37*c* recessed outward in the radial direction is formed on the inner circumferential face of the center hole 37*d*. As illustrated in FIGS. 25A and 25B, when the energizing ring 37 is mounted on the circumference of the first sealing member 333, the ring protrusion 36 enters and engages the engaging recess groove 37*c*, and the front end flange 333*b* is stored in the center hole 37*d*, and the front end face 333*a* of the elastic cylindrical member 331 is approximately flush with the front end face 37*a* of the energizing ring 37.

The shape and size of the engaging recess groove 37*c* are formed in such a manner that the ring protrusion 36 is pressed to the center of the center hole 32 in a state where the energizing ring 37 is mounted on the circumference of the first sealing member 333, and the engaging recess groove 37*c* and the ring protrusion 36 are engaged. Thus, as illustrated in FIG. 25A, when the energizing ring 37 is mounted on the circumference of the first sealing member 333, and the axis part 52 of the terminal 51 is inserted into the center hole 32 of the elastic cylindrical member 331, the sealing ring 36*a* formed at the section corresponding to the ring protrusion 36 is pressed against the outer circumferential face of the axis part 52, thereby providing sealing contact between the elastic cylindrical member 331 and the axis part 52. That is, a part on which at least the sealing ring 36*a* on the inner circumferential face of the first sealing member 333 is formed functions as the first sealing face and provides sealing contact between the elastic cylindrical member 331 and the axis part 52.

In the present embodiment, the coil spring 71 is mounted on the elastic cylindrical member 331 in such a manner as to surround the outer circumference of the central cylinder 335 in a range between the second sealing member 334 being the flange 38 and the energizing ring 37 mounted on the circumference of the first sealing member 333. Moreover, when the elastic cylindrical member 331 with the coil spring 71 mounted thereto is combined with the terminal 51, and the rear end of the terminal storage case 12 stored in the terminal storage cavity 15 is connected to the base part 11, the same as with the first embodiment, the length in the front-and-rear direction of the elastic cylindrical member 331 to which the coil spring 71 is mounted is set slightly longer than the length in the front-and-rear direction of the terminal storage case 12, and thus the rear end face 334*a* is brought into a state of being displaced forward by the bottom face 18*a* of the front recess part 18, and the elastic cylindrical member 331 is compressed in the front-and-rear direction, and the coil spring 71 and the elastic cylindrical member 331 are in a state where a preload is applied. Moreover, the second sealing member 334 is pressed by the rear end of the coil spring 71, and thus the rear end face 334*a* is pressed against the bottom face 18*a* of the front recess part 18, thereby functioning as the second sealing face that provides sealing contact between the elastic cylindrical member 331 and the base part 11. In addition, the rear end face 37*b* of the energizing ring 37 mounted on the circumference of the first sealing member 333 is abutted and pressed to the front end of the coil spring 71, and thus the front end face 37*a* of the energizing ring 37 is pressed to the rear face 53*a* of the flange 53 along with the front end face 333*a* of the elastic cylindrical member 331. The front end face 333*a* of the elastic cylindrical member 331 of the present invention has a smaller area than that in the first invention, however, the front end face 333*a* is pressed to the rear face 53*a* of the flange 53, and therefore functions as an auxiliary sealing face that provides auxiliary sealing contact between the elastic cylindrical member 331 and the flange 53.

Thus, in the present embodiment, the energizing ring 37 is disposed on the circumference of the first sealing member 333, and at least part of the inner circumferential face of the first sealing member 333 is pressed against the outer circumferential face of the axis part 52, thereby providing sealing contact between the inner circumferential face of the first sealing member 333 and the outer circumferential face of the axis part 52. Consequently, even when the dust, moisture, gas, and the like that exist in the space in front of the base part 11 make an entry through a gap between the contact part 54 and the front through-hole 14*a*, the dust, moisture, gas, and the like cannot enter the peripheral space of the axis part 52. Thus, liquid-tightness and airtightness are steadily maintained, thereby preventing the dust, moisture, gas, and the like from entering the space in rear of the base part 11 through a gap between the rear end proximity part 52*b* of the axis part 52 and the rear through-hole 11*a* of the base part 11.

In addition, the connector 1 includes the elastic cylindrical member 331 that includes the first sealing member 333, the second sealing member 334, and the central cylinder 335 having both ends thereof integrally connected to the first sealing member 333 and the second sealing member 334, the outer diameter of the second sealing member 334 is larger than the outer diameter of the central cylinder 335, the ring protrusion 36 engaged with the energizing ring 37 is formed on the outer circumference of the first sealing member 333, the coil spring 71 is disposed on the outside of the central cylinder 335, and the front end and the rear end of the coil spring 71 abut the energizing ring 37 and the second sealing member 334. Thus, the mounting of the coil spring 71 is facilitated, the assembly of the connector 1 is facilitated, and the manufacturing cost can be reduced.

Further, the elastic cylindrical member 331 includes the center hole 32 extended in the front-and-rear direction, the axis part 52 is stored in the center hole 32, part of the inner circumferential face of the first sealing member 33 is the sealing ring 36*a* that protrudes to the center of the center hole 32, and the sealing ring 36*a* is pressed against the outer circumferential face of the axis part 52. This effectively provides sealing contact between the inner circumferential face of the first sealing member 333 and the outer circumferential face of the axis part 52.

Further, the preload is applied to the coil spring 71 in a state where the front end 54*a* of the contact part 54 is not in contact with the mating terminal 151 of the mating connector 101, and the rear end face 334*a* of the second sealing member 334 is pressed against the bottom face 18*a* of the front recess part 18 of the base part 11. Thus, even when the connector 1 is in a state before being connected to the mating connector 101, the contact between the rear end face 334*a* of the second sealing member 334 and the bottom face 18*a* of the front recess part 18 of the base part 11 is securely sealed, thereby providing sealing contact between the front and the rear of the base part 11 with airtightness and liquid-tightness.

It should be noted that descriptions of configurations and operations of other aspects of the connector 1 and the mating connector 101 that are identical to those of the first through fourth embodiments will be omitted.

Note that the disclosure of the present specification describes characteristics related to preferred and exemplary embodiments. Various other embodiments, modifications, and variations within the scope and spirit of the claims appended hereto could naturally be conceived by persons skilled in the art by summarizing the disclosures of the present specification.

The present disclosure can be applied to connectors.

The invention claimed is:

1. A connector comprising:

a housing configured to include a base part where a rear through-hole is formed, and a terminal storage case which includes a front plate part where a front through-hole is formed, and in which a rear end is connected to the base part;

a terminal configured to include an axis part, a contact part connected to a tip end of the axis part, and a flange disposed at a boundary part between the contact part and the axis part, a rear end proximity part of the axis part being slidably inserted into the rear though-hole, a conduction body being connected to a part of the rear end proximity part, the part protruding rearward with respect to a rear face of the base part, the contact part being slidably inserted into the front through-hole, and a front end of the contact part protruding forward with respect to the front plate part being contactable with a mating terminal of a mating connector;

an energizing member configured to be mounted on a circumference of the axis part and energize the flange to a front; and a cylindrical sealing member configured to include a first sealing member interposed between a tip end of the energizing member and the flange, a second sealing member interposed between a rear end of the energizing member and the base part, and a central cylinder for connecting the first sealing member with the second sealing member.

2. The connector according to claim 1, wherein a rear end face of the second sealing member is pressed against a front face of the base part, thereby providing sealing contact between the rear end face and the front face.

3. The connector according to claim 1, wherein a front end face of the first sealing member is pressed against a rear face of the flange, thereby providing sealing contact between the front end face and the rear face.

4. The connector according to claim 3, wherein the energizing member is embedded in a cylindrical sealing member, a front part of the cylindrical sealing member with respect to a front end of the energizing member is the first sealing member, and a rear part of the cylindrical sealing member with respect to a rear end of the energizing member is the second sealing member.

5. The connector according to claim 4, wherein the cylindrical sealing member includes a center hole extended in a front-and-rear direction, and the terminal and the cylindrical sealing member are combined in such a manner that the axis part is stored in the center hole, and are stored in a terminal storage cavity of the terminal storage case.

6. The connector according to claim 4, wherein a part including at least the first sealing member and a part including at least the second sealing member in the cylindrical sealing member include an inside part positioned inside the energizing member and an outside part positioned outside the energizing member.

7. The connector according to claim 6, wherein the inside part and the outside part are cylindrical.

8. The connector according to claim 6, wherein the inside part is cylindrical, and a cross-sectional face of an outer circumferential face of the outside part is approximately a regular square.

9. The connector according to claim 6, wherein an area of a cross-sectional face of the inside part and an area of the cross-sectional face of the outside part are identical.

10. The connector according to claim 4, wherein a preload is applied to the energizing member in a state where the front end of the contact part is not in contact with the mating terminal of the mating connector, the front end face of the first sealing member is pressed against the rear face of the flange, and the front end face of the second sealing member is pressed against the front face of the base part.

11. The connector according to claim 1, wherein a radial-direction energizing member is disposed in a circumference of the first sealing member, and at least a part of an inner circumferential face of the first sealing member is pressed against an outer circumferential face of the axis part, thereby providing sealing contact between the inner circumferential face and the outer circumferential face.

12. The connector according to claim 11, wherein the connector includes the cylindrical sealing member that includes the first sealing member, the second sealing member, and the central cylinder having both ends integrally connected to the first sealing member and the second sealing member, an outer diameter of the second sealing member is larger than an outer diameter of the central cylinder, an engaging protrusion engaged with the radial-direction energizing member is formed on the outer circumference of the first sealing member, the energizing member is disposed on an outside of the central cylinder, and a front end and a rear end of the energizing member abut the radial-direction energizing member and the second sealing member.

13. The connector according to claim 12, wherein the cylindrical sealing member includes a center hole extended in a front-and-rear direction, the axis part is stored in the center hole, a part of the inner circumferential face of the first sealing member is a sealing ring that protrudes to a center of the center hole, and the sealing ring is pressed against the outer circumferential face of the axis part.

14. The connector according to claim 11, wherein a preload is applied to the energizing member in a state where the front end of the contact part is not in contact with the mating terminal of the mating connector, and the rear end face of the second sealing member is pressed against the front face of the base part.

* * * * *